US006615952B2

(12) United States Patent
Itoh et al.

(10) Patent No.: US 6,615,952 B2
(45) Date of Patent: Sep. 9, 2003

(54) DOUBLE DECK ELEVATOR

(75) Inventors: Hiroaki Itoh, Fuchu (JP); Hideya Kohara, Fuchu (JP); Masahiro Hayakawa, Hachioji (JP); Gen Yokoi, Fuchu (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/795,357

(22) Filed: Mar. 1, 2001

(65) Prior Publication Data

US 2001/0018996 A1 Sep. 6, 2001

(30) Foreign Application Priority Data

Mar. 2, 2000 (JP) ..... 2000-056981
Dec. 25, 2000 (JP) ..... 2000-392049

(51) Int. Cl.[7] ..... B66B 13/28; B66B 11/02
(52) U.S. Cl. ..... 187/249; 187/400
(58) Field of Search ..... 187/249, 400

(56) References Cited

U.S. PATENT DOCUMENTS 1,738,729 A * 12/1929 Richardson ..... 187/400
4,058,191 A * 11/1977 Balbo ..... 187/414
4,723,627 A * 2/1988 Ito ..... 187/16
5,377,784 A * 1/1995 Walkowiak et al. ..... 187/336
5,960,910 A * 10/1999 Traktovenko ..... 187/401

FOREIGN PATENT DOCUMENTS

| | | | |
|---|---|---|---|
| EP | 982260 | * | 3/2000 |
| GB | 2280662 | * | 8/1995 |
| JP | 3158377 | * | 7/1991 |
| JP | 4298482 | * | 10/1992 |
| JP | 5186170 | * | 7/1993 |

* cited by examiner

*Primary Examiner*—Steven A. Bratlie
(74) *Attorney, Agent, or Firm*—Finnegan, Henderson, Farabow, Garrett & Dunner, L.L.P.

(57) ABSTRACT

A double deck elevator comprising an upper cage and a lower cage vertically movable together in a hoistway, wherein a space between the upper cage and the lower cage is covered by covers. The covers guide airflow flowing around the space to reduce air turbulence noise, and consequently the ride in the cages becomes quieter and more comfortable.

15 Claims, 23 Drawing Sheets

DOUBLE DECK ELEVATOR

BACKGROUND OF THE INVENTION

1. Field of the Invention

The present invention relates to a double deck elevator comprising an upper cage and a lower cage vertically movable together in a hoistway, and more particularly to a double deck elevator wherein a space existing between the upper cage and the lower cage is covered with covers for reducing air turbulence noise to provide a quieter and more comfortable ride in the cages.

2. Description of the Related Art

In conventional double deck elevators shown in FIGS. 23, 24 and 25, a hoistway 1 is provided with a pair of guide rails 2 vertically extending along the inner walls of the hoistway 1 respectively, and a cage assembly 3 hoisted by a main rope 4 is arranged between the guide rails 2 to move vertically, guided by the guide rails 2.

The cage assembly 3 comprises a cage frame 5, an upper cage 6 and a lower cage 7 mounted on the case frame respectively. A plurality of guide means 8, which have guide rollers 8*a* to roll on the respective guide rails 2, are provided at a top-side, a bottom-side, left and right sides of the cage frame 5.

On a middle beam 9 and a bottom beam 10 of the cage frame 5, cage receiving frames 11 and 12 are mounted respectively. Between the cage receiving frame 11 and the bottom of the upper cage 6, and between the cage receiving frame 12 and the bottom of the lower cage 7, load cells 13 are inserted with vibroisolating rubbers 14, respectively. The weights of the upper cage and lower cages 6, 7 respectively detected by the load cells 13 are used for various purposes.

Displacement sensors 15 are provided between the bottom surface of the upper cage 6 and the middle beam 9, and between the bottom surface of the lower cage 7 and the bottom beam 10, respectively, so that the displacement of the upper and lower cages 6, 7 can be detected.

As mentioned above, the cage assembly 3 is hoisted by the main rope 4. In a case of 1:1 roping system, the main rope 4 is directly connected to the upper beam 16 of the cage frame 5 (FIG. 24). And in a case of 2:1 roping system, the main rope 4 is wound around sheaves 17 provided on the upper beam 16 of the cage frame 5 (FIG. 25).

When the upper and lower cages 6, 7 arrive at the floors called by passengers, the cage doors 18 of the cages 6, 7 facing the hall doors 19 are opened and closed by a door-driving unit 20. Hall sills 21 are provided on the floors, and cage sills 22 are provided on the floors of the upper and lower cages 6, 7 respectively, such that doors can open and close smoothly.

In the conventional double deck elevators described above, a space "S" exists between the upper cage 6 and the lower cage 7 and the door-driving unit is installed in the space "S". When the upper and lower cages move vertically in the hoistway 1, airflow flowing around the cages enters the space "S" and generates air turbulence around the door-driving unit 20. The air turbulence is loud enough to disturb passengers in the upper and lower cages 6, 7, making their ride noisy and uncomfortable.

SUMMARY OF THE INVENTION

It is therefore a general object of the present invention to provide a double deck elevator that can reduce air turbulence noise and provide a quiet and comfortable ride for passengers in the cages.

This object can be achieved by covering a space existing between an upper cage and a lower cage with covers for covering the space at a door-side, two lateral-sides and a backside with covers.

According to the present invention, since the space between the cages is covered with the covers, air cannot flow through devices arranged in the space, and therefore air turbulence is not presented. Consequently, noise caused by air turbulence is reduced and passengers can enjoy a quieter and more comfortable ride in the cages.

Since the covers stabilize the airflow, the air resistance of the cages is reduced and the vertical moving speed of the cages can be increased.

Since the space between the upper and lower cages is isolated from a general space in the hoistway by the covers, noise in the hoistway caused by the vertical moving of the cages cannot enter the cages through the space, and this ensures an even quieter and more comfortable ride an the cages.

The covers are attached to at least one of the upper cage, the lower cage and the cage frame on which the cages are mounted with an elastic material to absorb vertical distance change between the cages.

For reducing air turbulence noise in the hoistway, and for reducing the air resistance of the cages, capsule-type air guiding members can be arranged above the upper cages and below the lower cages, respectively. The air guiding members guide the airflow into clearances between the inner walls of the hoistway and the outer side surfaces of the cages.

The door-side cover is positioned closer to the door-side inner wall of the hoistway than a door-driving unit that opens and closes the doors of the cages, to prevent the airflow from entering the space around the door-driving unit. In this case, the door-side cover is provided with slits through which the door links connecting the doors to the door-driving unit are inserted. And the door-side cover is provided with slit-closing members that close a clearance between the periphery of the slit and the door links, to prevent the airflow from entering the space through the slit and causing the air turbulence noise.

The double deck elevator comprises a catching member for catching objects, such as dust, dirt and water, dropped through a clearance between the door-side inner wall of the hoistway and the upper cage, the door-side cover is provided with an opening through which the catching member approaches and retracts from the door-side inner wall of the hoistway. And the door-side cover is provided with an opening-closing member for closing the opening, and/or a clearance-closing member for closing a clearance between the catching member and the door-side cover, to prevent airflow from entering the space through the opening and/or through the clearance, and to prevent airflow from causing the air turbulence noise.

BRIEF DESCRIPTION OF THE DRAWINGS

For a better understanding of the invention as well as other objects and features thereof, reference is made to the following detailed description to be read in conjunction with the accompanying drawings, and like reference characters designate corresponding parts in the several views, wherein:

FIGS. 1A and 1B are schematic front and side elevation views showing a double deck elevator of the present invention, in which FIG. 1A is a sectional drawing along the line X—X in FIG. 1B, and FIG. 1B is a sectional drawing along the line Y—Y in FIG. 1A.

DETAILED DESCRIPTION OF THE PREFERRED EMBODIMENTS

Figure 1:
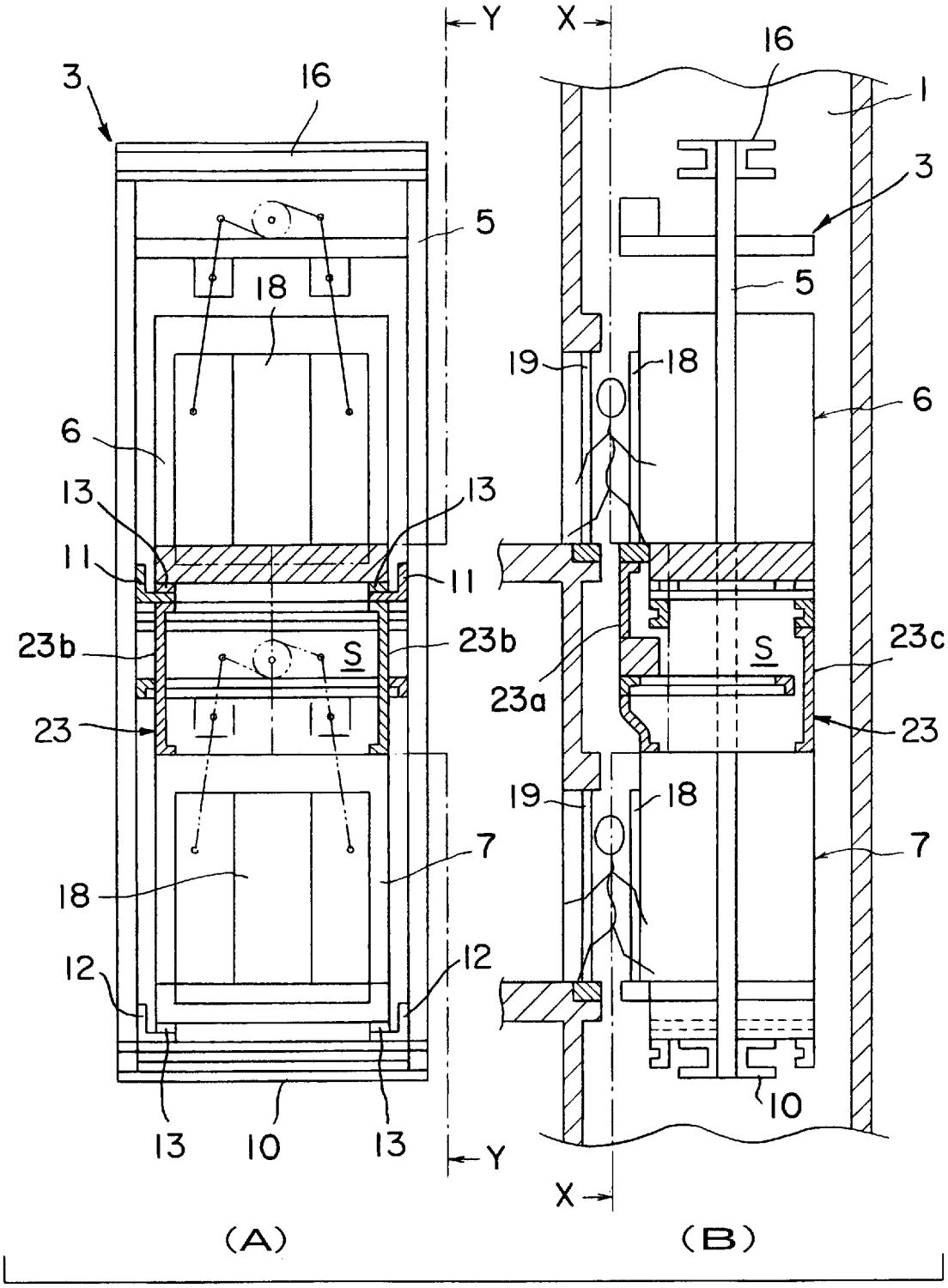

Referring to the attached drawings, in FIGS. 1A and 1B, there is shown a double deck elevator comprising an upper cage 6 and a lower cage 7 vertically movable together in a hoistway 1.

A space "S" existing between the upper cage 6 and the lower cage 7 is covered by the covers 23 including a door-side cover 23*a*, two lateral-side covers 23*b* and a backside cover 23*c*. That is, the space "S" is covered at a door-side, two lateral-sides and backside, respectively.

Figure 2:
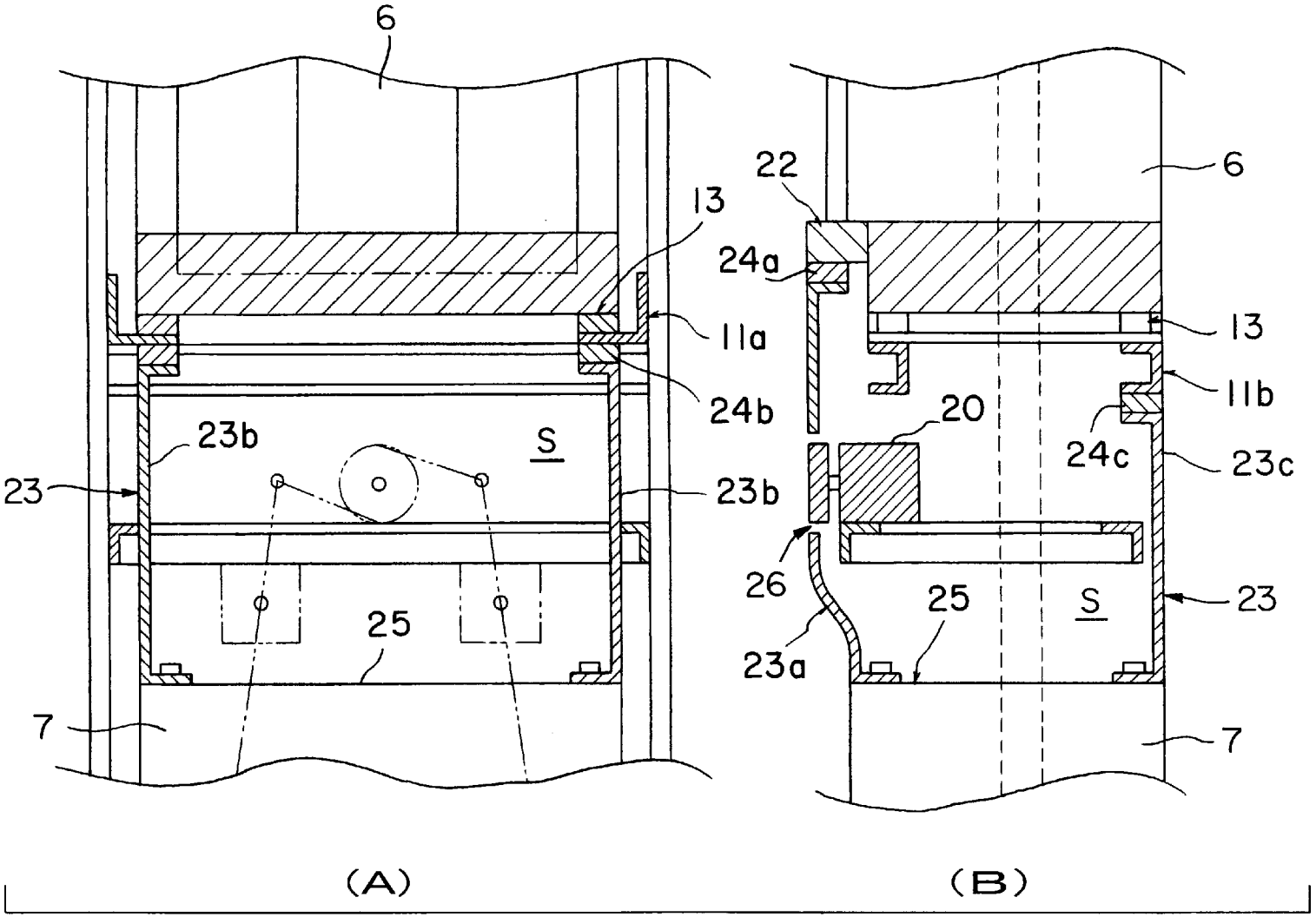
FIGS. 2A and 2B are enlarged sectional front and side elevation views of the covers shown in FIGS. 1A and 1B.

As shown in FIGS. 2A and 2B, the door-side cover 23*a* is formed so that its bottom half curves into the space "S" to absorb horizontal position difference between a sill 22 of the upper cage 6 and a ceiling 25 of the lower cage 7. And, all of these covers have smooth flat outer surfaces that are connected to the outer side surf aces of the upper and lower cages 6, 7 each other without steps. And the door-side cover 23*a* is provided with an opening 26 into which the front portion of a door-driving unit 20 is inserted.

This construction enables airflow to flow smoothly around the space and cages 6, 7, and prevent the airflow from entering the space and flowing around devices arranged in the space "S" when the cages 6, 7 move vertically in the hoistway 1. Consequently, noise caused by airflow turbulence and air resistance of the cages are reduced.

As shown in FIGS. 1A and 1B, since the upper and lower cages 6, 7 are supported on the floor receiving frames 11, 12, respectively, by means of vibroisolating rubber 13, vertical distance between the upper and lower cages 6, 7 changes due to the weight changes of the cages 6, 7.

However, as shown in FIGS. 2A and 2B, the top edge of the door-side cover 23*a* is fixed to a cage sill 22 by means of an elastic material 24*a*, and its bottom edge is directly fixed to a ceiling 25 of the lower cage 7. Also, the top edges of the lateral-side covers 23*b* are attached to a frame 11*a* extending from a door-side to a backside within a cage frame 5 by means of a elastic material 24*b*, and its bottom edge is directly fixed to the ceiling 25 of the lower cage 7. Further, the top edge of the backside cover 23*c* is attached to the floor receiving frame 11*b* extending between two lateral-sides by means of a elastic material 24*c*, and its bottom edge is directly fixed to the ceiling 25 of the lower cage 7. These elastic materials 24*a*, 24*b* and 24*c*, such as rubber block, absorb the vertical distance change between the cages 6, 7 and prevent the deformation of the covers.

In addition, it is possible to insert an elastic material between the bottom edges of the covers and the ceiling 25 of the lower cage 7.

Figure 3:
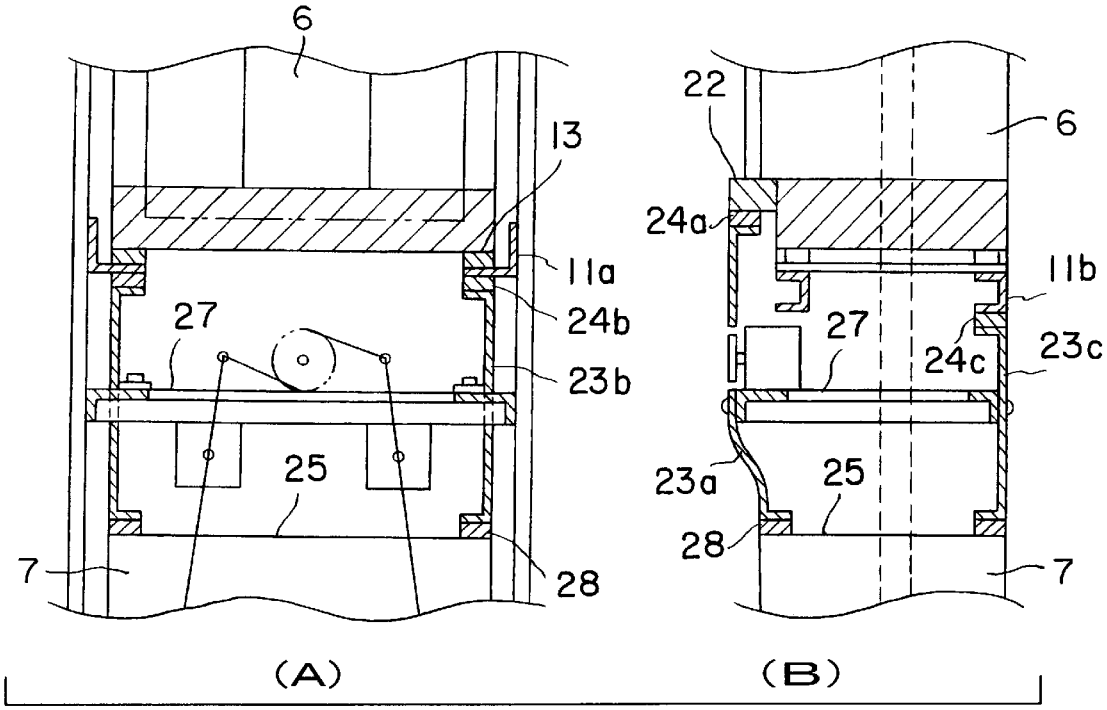
FIGS. 3A and 3B are enlarged sectional front and side elevation views of the covers of another embodiment.

In an embodiment of the double deck elevator shown in FIGS. 3A and 3B, the door-side cover 23*a*, the two lateral-side covers 23*b* and the backside cover 23*c* are fixed to the middle cage frame 27 at vertical middle portions thereof, respectively. And, elastic materials 24*a*, 24*b* and 24*c* are inserted between the top edges of the respective covers and the sill 20 or the floor receiving frame 11*a* and 11*b* of the upper cage. Also, elastic materials 28 are inserted between the bottom edge of the respective covers and the ceiling 25 of the lower cage 7. Accordingly, these elastic materials 24*a*, 24*b*, 24*c* and 28 absorb distance change between the cages 6, 7 and prevent the deformation of the covers.

Figure 4:
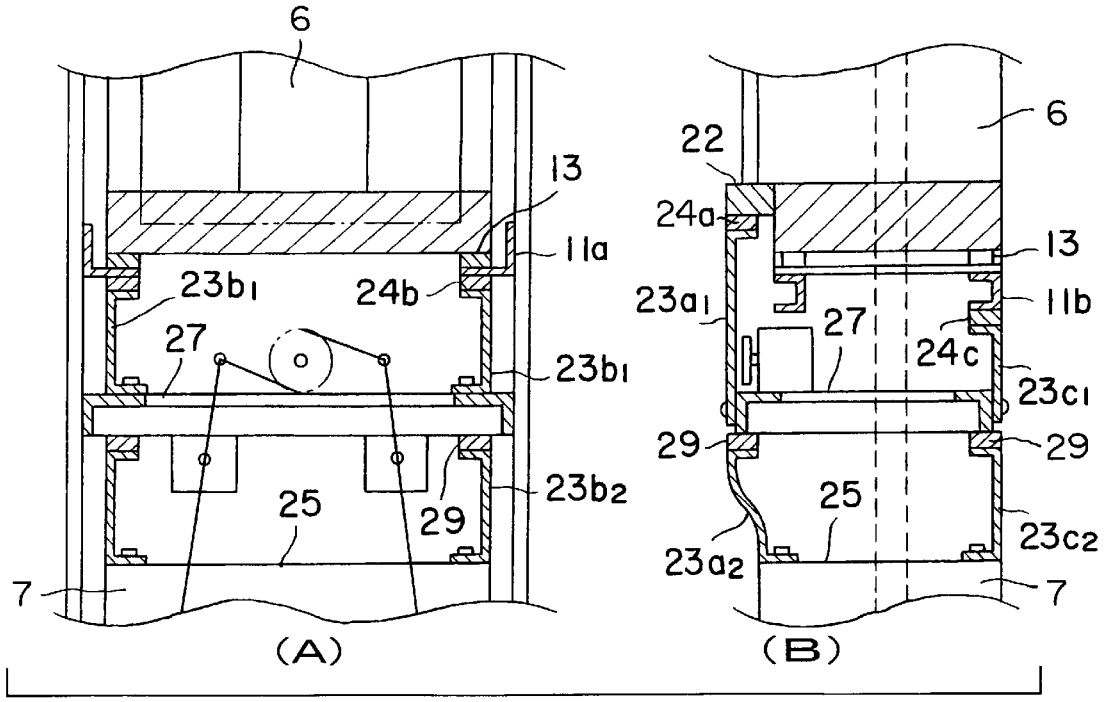
FIGS. 4A and 4B are enlarged sectional front and side elevation views of the covers of another embodiment.

In an embodiment of the double deck elevator shown in FIGS. 4A and 4B, respective covers are divided into upper and lower pieces. That is, the door-side cover 23*a* consists of upper pieces 23*b*1 and lower pieces 23*b*2, also the backside cover consists of upper piece 23*c*1 and lower piece 23*c*2. Bottom edges of the upper pieces 23*a*1 and 23*c*1 are directly fixed to the cage frame 27, and the top edges of them are fixed to the sill 22 of the upper cage_6, floor receiving frame 11*a* and 11*b* by means of elastic material 24*a*, 24*b* and 24*b*, respectively. And, the bottom edges of the lower pieces

23*a*2, 23*b*2 and 23*c*2 are directly fixed to the ceiling 25 of the lower cage 7, and the top edges of them are fixed to the cage frame 27 by means of elastic material 29, respectively. Accordingly, these elastic materials 24*a*, 24*b*, 24*c*, 28 and 29 absorb distance change between the cages 6, 7 and avoid the deformation of the covers.

In addition, it is possible to fix the bottom edges of the upper pieces 23*a*1, 23*b*1 and 23*c*1 by means of the elastic materials 24*a*, 24*b* and 24*b*, respectively, and to directly fix the top edges of them to the sill 22 of the upper cage_6, floor receiving frame 11*a* and 11*b*, respectively. Also it is possible to fix bottom edges of the lower pieces 23*a*2, 23*b*2 and 23*c*2 by means of elastic materials 29, respectively, and to directly fix the top edges of them to the cage frame 27, respectively.

Figure 5:
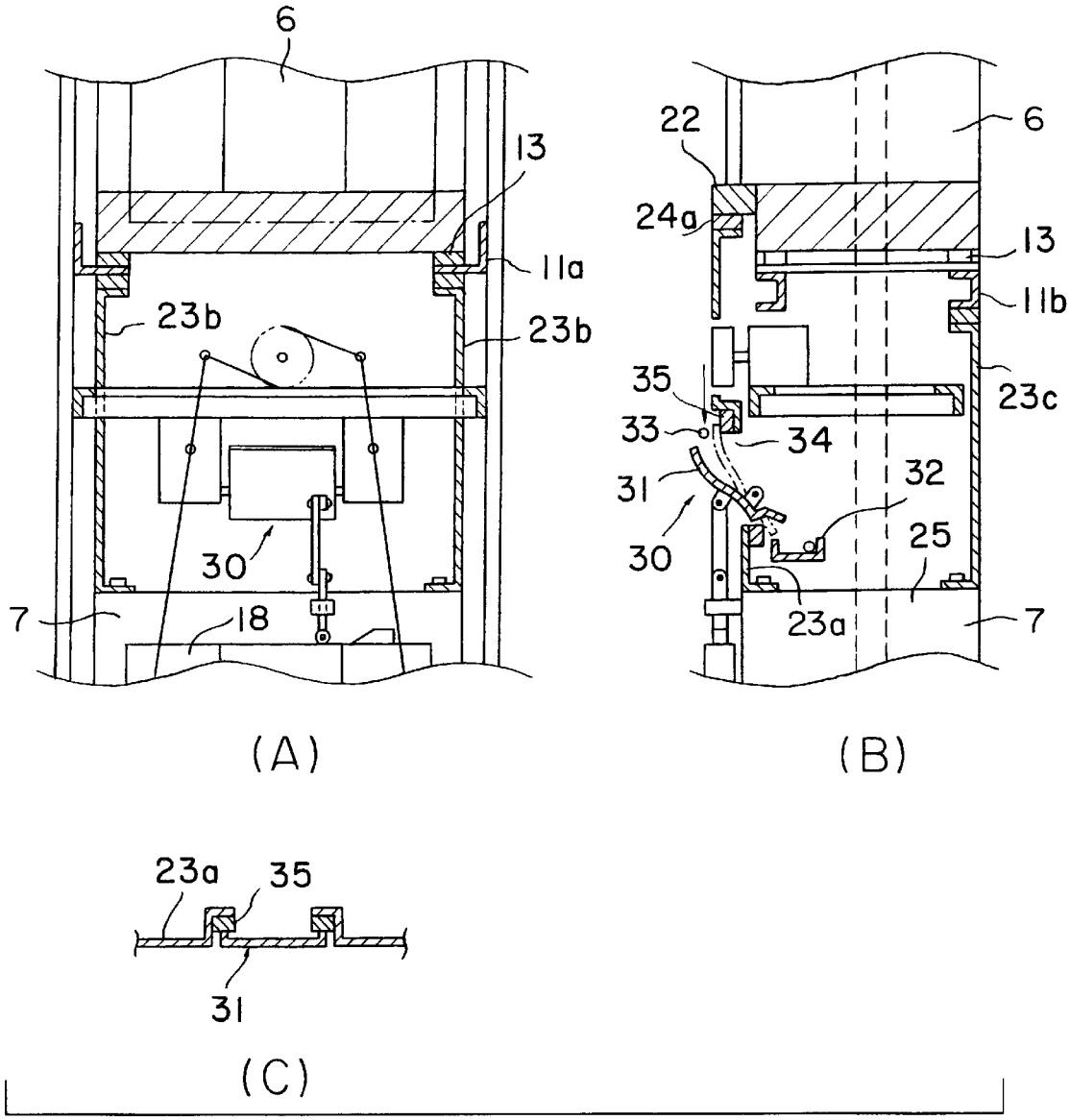
FIGS. 5A, 5B are enlarged sectional front and side views of the covers of another embodiment.
FIG. 5C is a sectional plan view of the catching plate shown in FIGS. 5A and 5B.

In an embodiment of the double deck elevator shown in FIGS. 5A and 5B, there is provided a catching device 30 at a door-side of the space between cages 6, 7, which catches objects, such as dust, dirt or water dropped through a clearance between a door-side inner wall of the hoistway 1 and the upper cage 6. catching device 30 has a catching plate 31 that swings around a horizontal axis to approach and retracts the door-side inner wall of the hoistway 1, and a receiving dish 32 arranged in the space for receiving the objects caught by the catching plate 31.

When the catching plate 31 swings to approach the door-side inner wall of the hoistway 1 as shown in FIGS. 5A and 5B by the solid lines, the catching plate 31 catches the objects 33 and guides it to the receiving dish 32 to protect passengers entering or exiting the lower cage 7 from such objects.

The door-side cover 23*a* is provided with an opening 34 which is opened and closed by the catching plate 31, and is provided with an opening closing member 35 attached along the periphery of the opening 34 that closes a clearance between the catching plate 31 and the periphery of the opening 34 when the catching plate 31 closes the opening 34 as shown in FIG. 5B by the phantom lines.

Since the airflow flowing along the door-side cover 23*a* is guided by the front cover 23*a* and the catching plate 31, air turbulence noise is reduced. Furthermore, the catching plate 31 blocks out the line of vision of a passenger at the entrance of the lower cage 7 who looks up at the passengers entering and exiting the upper cage 6.

Figure 6:
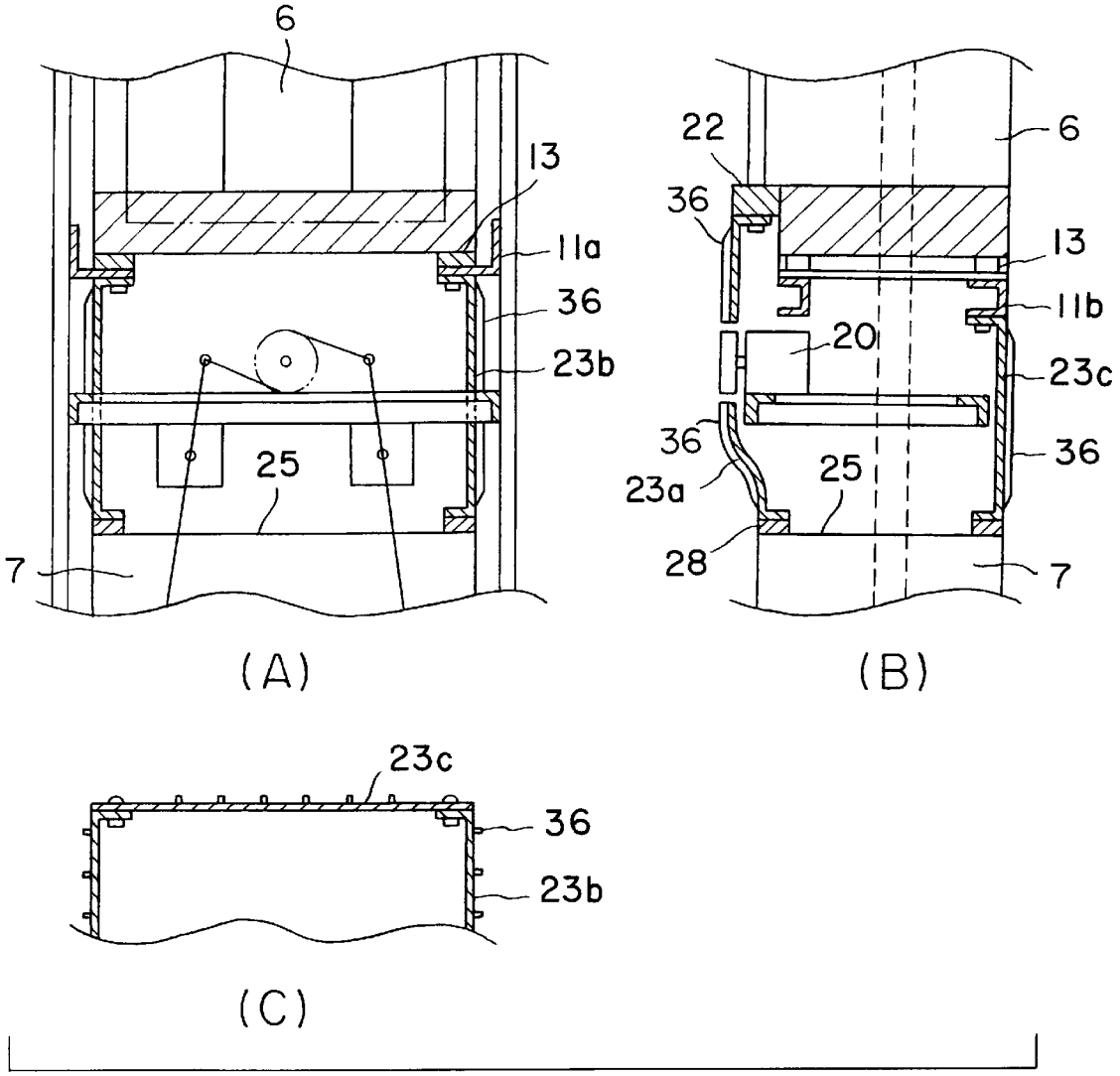
FIGS. 6A, 6B are sectional front and side elevation views of the covers of another embodiment.
FIG. 6C is a plan view of the covers shown in FIGS. 6A and 6B.

In an embodiment of the double deck elevator shown in FIGS. 6A and 6B, many airflow guiding plates 36 extending vertically are provided on the outer surfaces of the door-side cover 23*a*, two lateral-side covers 23*b* and the backside cover 23*c*. The airflow guiding plates 36, as airflow protrusions, guide and stabilize the airflow flowing along the outer surfaces of the covers to reduce air turbulence noise.

Figure 7:
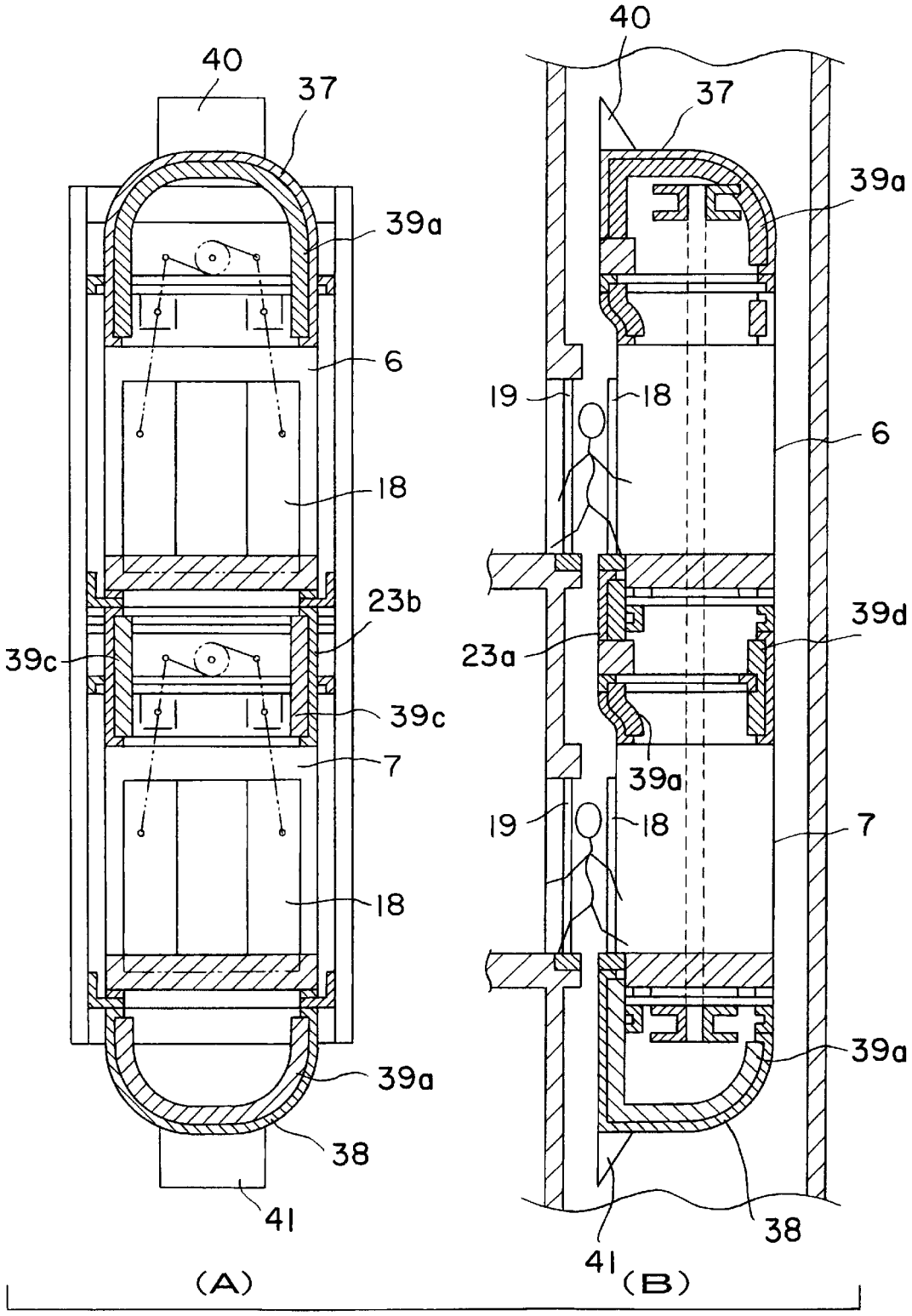
FIGS. 7A and 7B are schematic drawings showing a double deck elevator of another embodiment of the present invention.

In an embodiment of the double deck elevator shown in FIGS. 7A and 7B, capsule-type upper and lower air-guiding members 37, 38 are arranged above the upper cage 6 and below the lower cage 7, respectively, to guide the airflow into the clearances between inner walls of the hoistway 1 and outer side surfaces of the upper and lower cages 6, 7.

Also, vibroisolating and noise-absorbing materials 39*a*, 39*b*, 39*c* and 39*d* are attached to inner surfaces of the capsule-type air-guiding members 37, 38 and covers 23*a*, 23*b* and 23*c*.

Furthermore, air-guiding cones 40, 41 which have a triangular cross section for guiding the airflow flowing along the outer surfaces of the capsule-type upper and lower air-guiding members 37, 38 are arranged above the upper air-guiding member 37 and below the lower air-guiding device 38, respectively.

In this embodiment, since the capsule-type air-guiding members 37, 38, the upper cage 6 and the lower cage 7 form a smooth streamline shape, airflow flows smoothly along the outer surf aces of the same and air turbulence caused by the cages 6, 7 is reduced.

Also, since the vibroisolating and noise-absorbing materials 39*a*, 39*b*, 39*c* and 39*d* are provided, the vibration of the air-guiding members 37, 38 and covers 23*a*, 23*b* and 23*c* is reduced, also noise insulation is achieved.

Furthermore, since the airflow guiding cones 40, 41 are provided, the airflow flowing along the outer surface of the air-guiding member 37, 38 is guided more smoothly, and the resistance of the cages 6, 7 is reduced.

Figure 8:
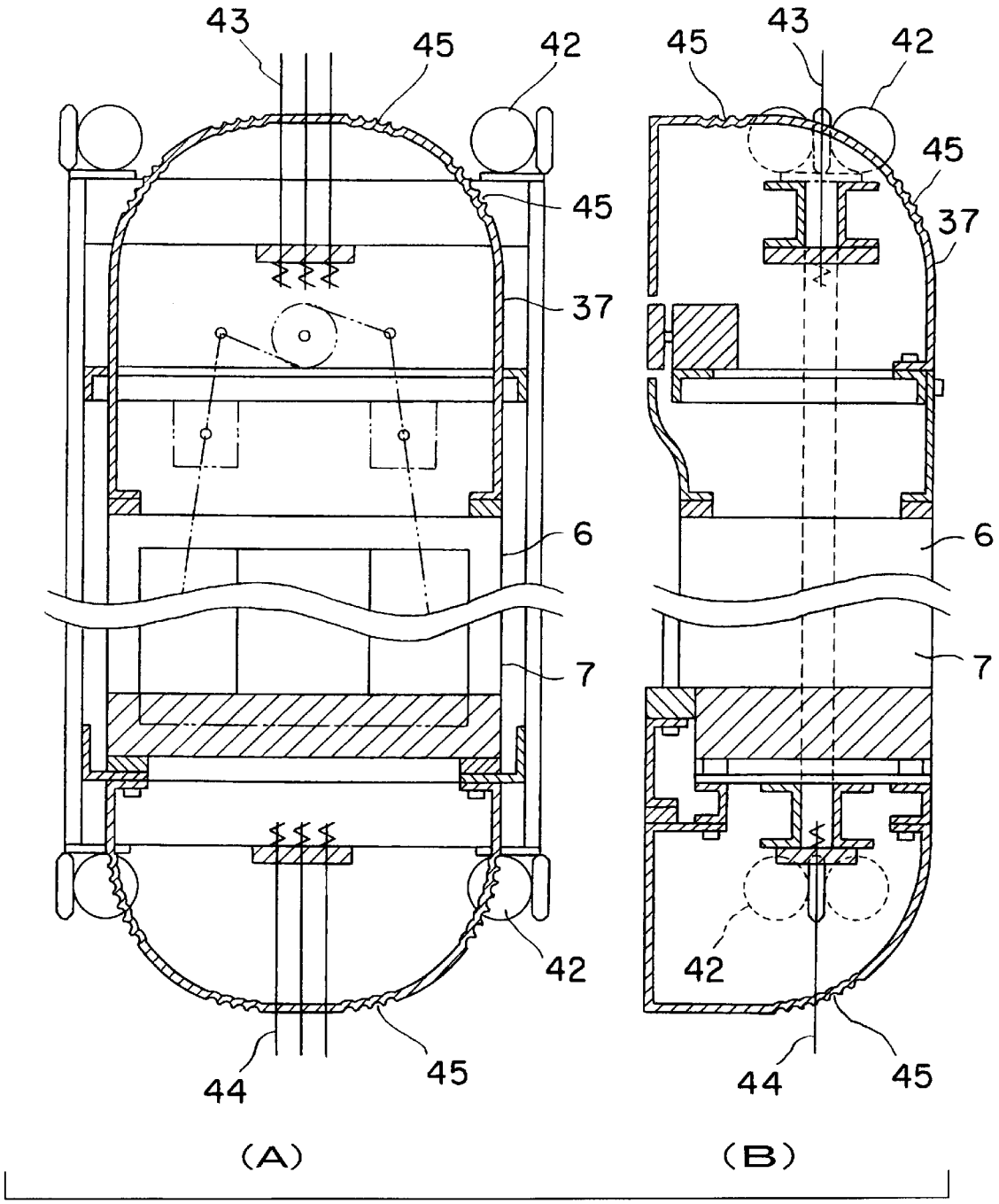
FIGS. 8A and 8B are schematic drawings showing a double deck elevator of another embodiment of the present invention.

In an embodiment of the double deck elevator shown in FIGS. 8A and 8B, uneven concave serrations 6, 7 are provided on the outer surface of the capsule-type air-guiding members 37, 38 in the periphery of the guide rollers 42, main rope 43 and compensation rope 44.

By this arrangement, the generation of air turbulence is reduced by the uneven concave serrations 6, 7, and accordingly noise reduction is achieved. In addition, it is possible to use uneven convex serrations to obtain the same effects.

Figure 9:
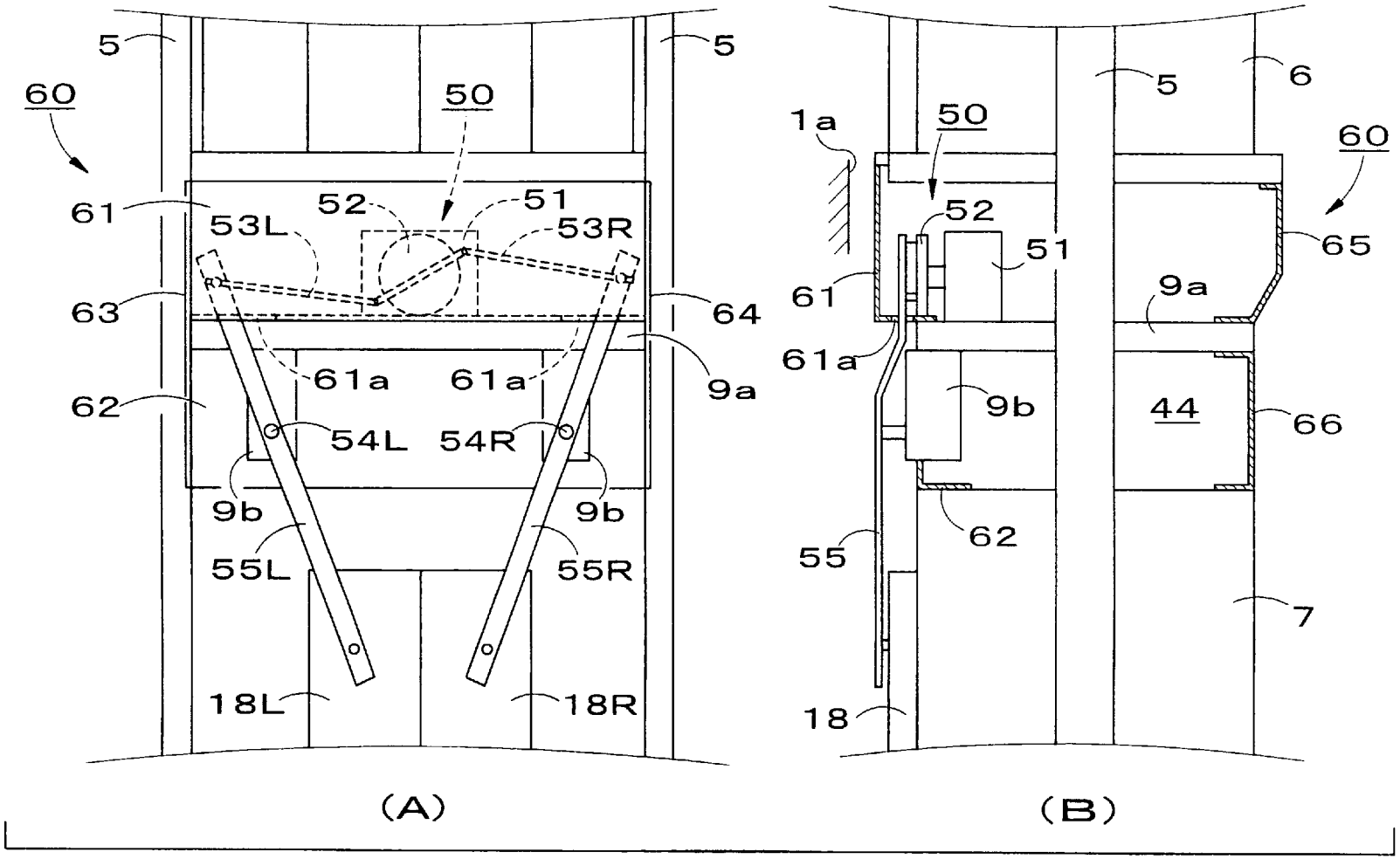
FIGS. 9A and 9B are enlarged schematic front and side elevation views showing a double deck elevator of another embodiment of the present invention.

In an embodiment of the double deck elevator shown in FIGS. 9A and 9B, cage door 18 provided on the lower cage 7 is opened and closed by a door driving unit 50 mounted on the horizontal beam 9*a* of the cage frame 5.

The door-driving unit 50 comprises a rotating disc 52 driven by a driving motor 51, and a pair of connecting links 53L, 53R are pivot ally connected to the rotating disc 52 at one end thereof, respectively. The other ends of the connecting links 53L, 53R are connected to the upper ends of door links 55L, 55R, respectively. The door links 55L, 55R are pivotally supported on the supporting member 9*b*, respectively by means of pivot shafts 54L and 54R provided on the respective support member 9*b* of the cage frame 5. Lower ends of the door links 55L, 55R are pivotally connected to the cage doors 18L, 18R, respectively. By this arrangement, the cage doors 18L, 18R are opened and closed by the driving motor 51.

The space 44 between the upper and lower cages 6, 7 is covered by a cover 60 that guides the airflow flowing along the space 44. The cover 60 comprises a pair of upper and lower door-side covers 61, 62, a pair of right and left side covers 63, 64 and a pair of upper and lower backside covers 65, 66.

The upper door-side cover 61 is positioned close to the door-side inner wall 1*a* of the hoistway 1 than the door driving unit 50 and covers the door driving unit 50. And, the upper door-side cover 61 is provided with a pair of slits 61*a*, through which door links 55L, 55R are inserted respectively.

By this arrangement, the upper door-side cover 61 fully covers the door driving unit 50 and the top portions of the door links 55L, 55R without preventing the movement of door links 55L, 55R.

Since the cover 60 guides the airflow, the airflow cannot enter the space 44 and cannot flow in the space 44, around such devices as the door-driving unit 50, and does not generate air turbulence. As a result, air turbulence noise can be effectively reduced when the cages 6, 7 move vertically in the hoistway 1 at a high speed, providing a quieter and more comfortable ride in the cages 6, 7.

At the same time, since the space 44 is separated from the inner space of the hoistway 1 by the cover 60, noise in the hoistway 1 cannot enter the cages 6, 7 through the space 44, then quietness and comfortableness in the cages 6, 7 is further improved.

And, since the cover 60 guides the airflow into clearances between the inner walls of the hoistway 1 and the outer side surfaces of the cages 6, 7, the air resistance of the cages 6, 7 is reduced and the moving speed of the cages 6, 7 can be increased.

Figure 10:
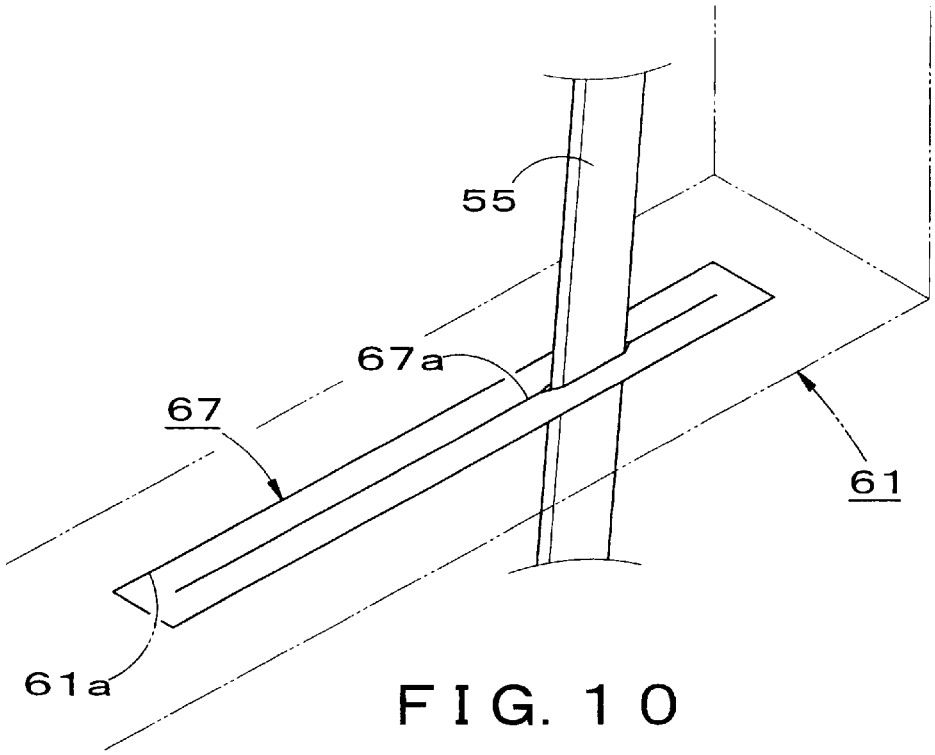
FIG. 10 is a perspective view showing a slit-closing member used with the covers shown in FIGS. 9A and 9B.

In an embodiment of the double deck elevator shown in FIG. 10, there is provided a slit-closing member 67 made of an elastic material, such as a rubber film or a thin plastic film, which closes a clearance between the periphery of the slit 61*a* and the door link 55. This slit-closing member 67 has a slit 67*a* extending along the moving direction of the door link 55, through which the door link 55 is inserted, and allows the displacement of the door link 55 by its elastic deformation caused by contact with the door link 55. By this arrangement, the airflow cannot enter or exit from the space 44 through the slit 61*a*, and does not generate air turbulence noise. As a result, a quieter and more comfortable ride in the cages 6, 7 can be achieved.

Figure 11:
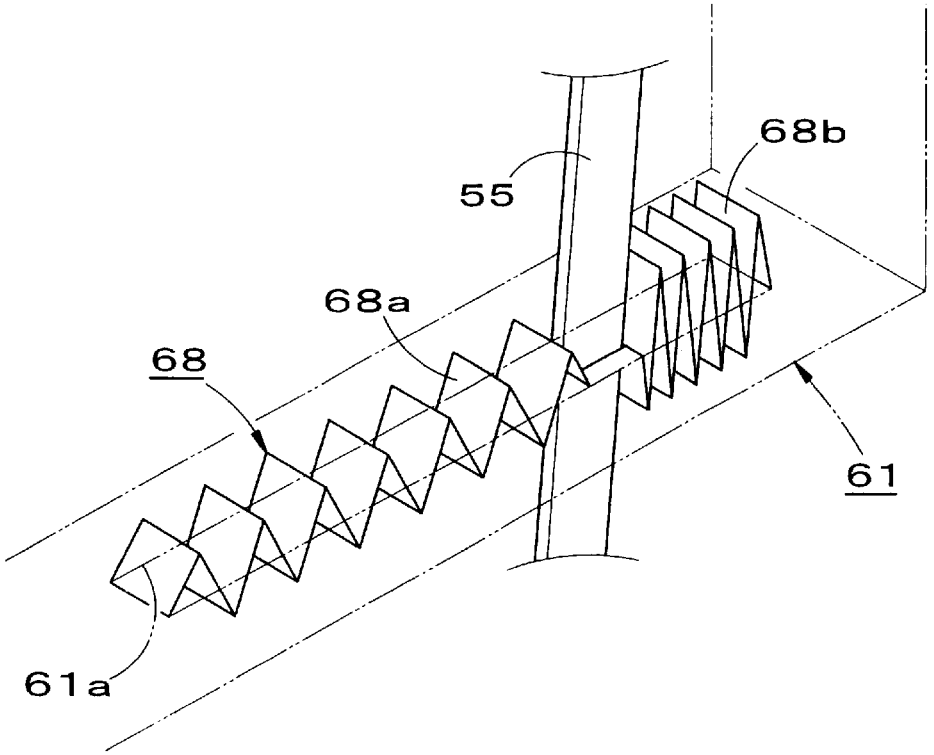
FIG. 11 is a perspective view showing a slit-closing member of another embodiment.

In an embodiment of the double deck elevator shown in FIG. 11, there is provided a bellows-type slit-closing member 68 made of an elastic material, such as a rubber film or a thin plastic film. This bellows-type slit-closing member 68 comprises a pair of bellows 68*a*, 68*b* that expand and contract along the moving direction of the door link 55 and closes the clearance between the periphery of the slit 61*a* and the door-link 55. This slit-closing member 68 has an aperture through which the door link 55 is inserted, and allows the displacement of the door link 55 by its elastic deformation caused by contact with the door link 55. By this arrangement, airflow cannot enter or exit the space 44 through the slit 61*a*, and does not generate air turbulence noise. As a result, a quieter and more comfortable ride in the cages 6, 7 can be achieved.

Figure 12:
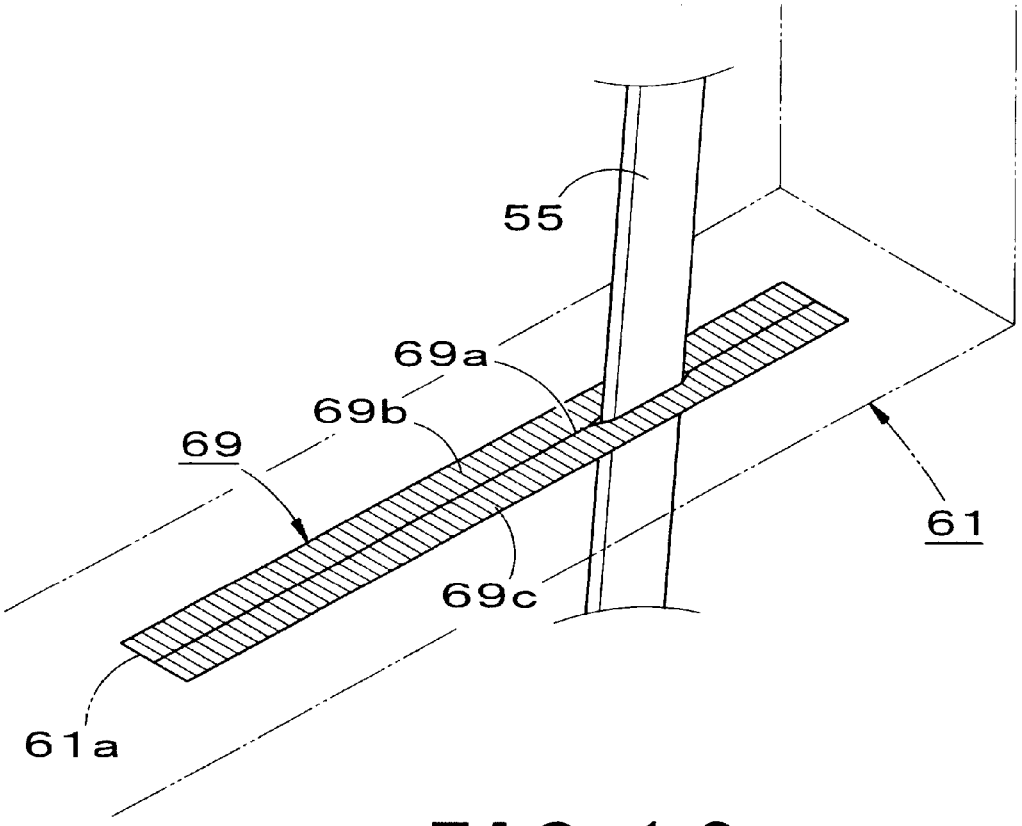
FIG. 12 is a perspective view showing a slit-closing member of another embodiment.

In an embodiment of the double deck elevator shown in FIG. 12, there is provided a brush-type slit-closing member 69 made of an elastic material, such as plastic bristles, which closes a clearance between the periphery of the slit 61*a* and the door link 55. This brush type slit-closing member 67 comprises a pair of front and rear brushes 69*b*, 69*c* facing each other to form a slit 69*a* extending along the moving direction of the door link 55. The slit 69*a* allows the displacement of the door link 55 by its elastic deformation caused by the contact with the door link 55. By this arrangement, the airflow cannot enter or exit from the space 44 through the slit 61*a*, and does not generate air turbulence noise. As a result, a quieter and more comfortable ride in the cages 6, 7 can be achieved.

Figure 13:
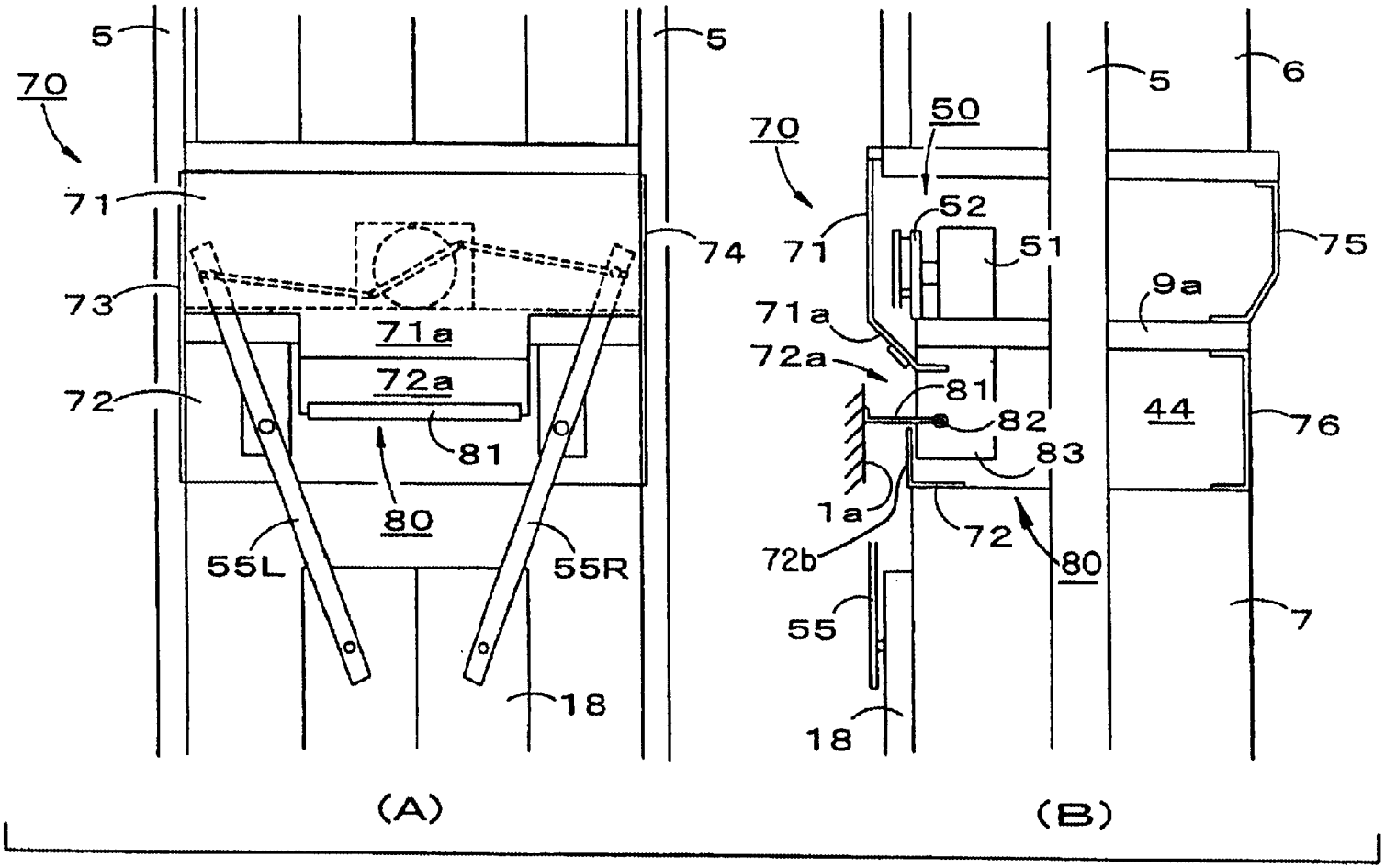
FIGS. 13A and 13B are enlarged schematic front and side elevation views showing a double deck elevator of another embodiment of the present invention.
Figure 14:
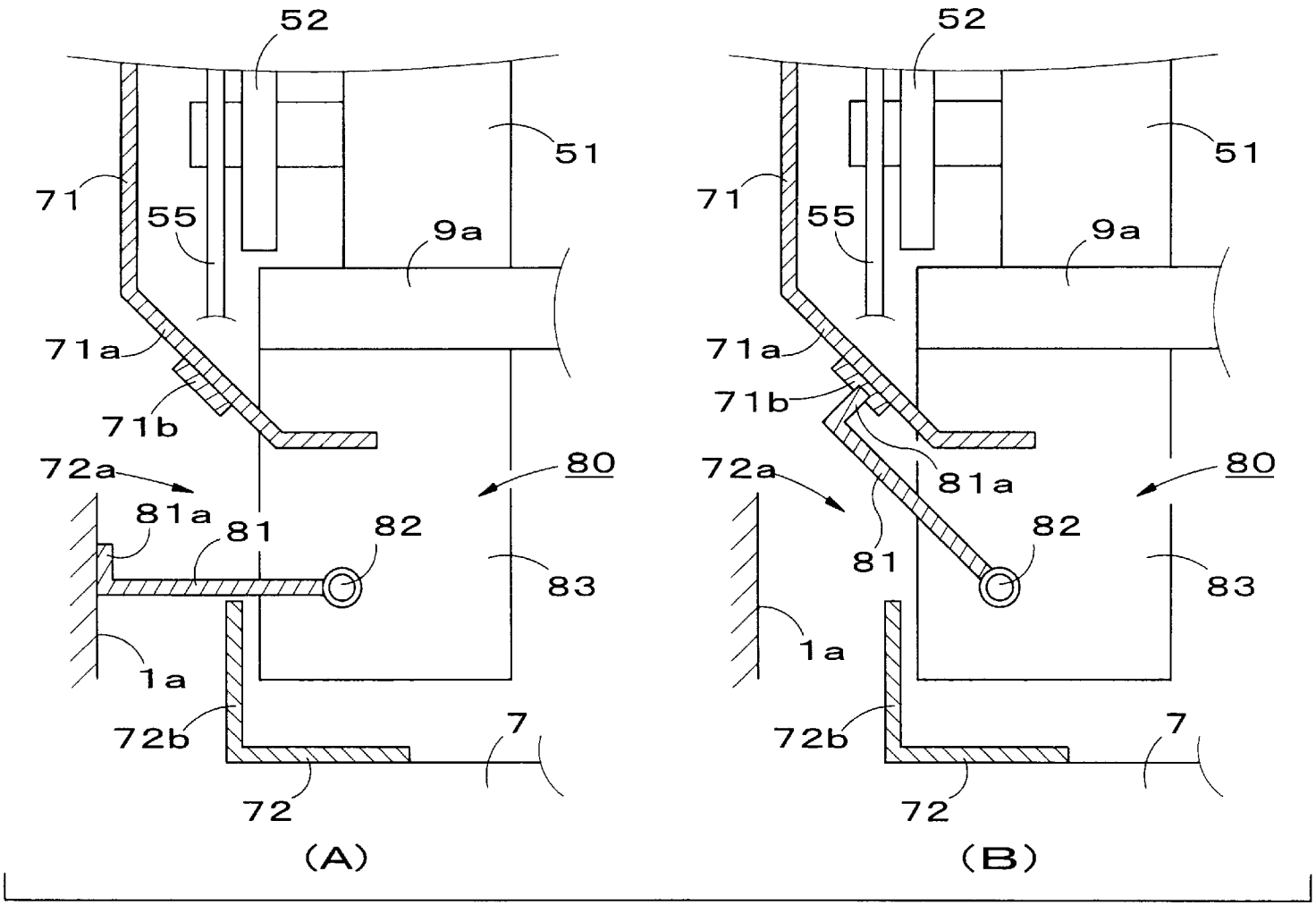
FIGS. 14A and 14B are enlarged sectional side elevation views of the clearance-closing member shown in FIGS. 13A and 13B.

In an embodiment of the double deck elevator shown in FIGS. 13 and 14, the space 44 between the upper and lower cages 6, 7 is covered by a cover 70, which comprises a pair of upper and lower door-side covers 71, 72, a pair of lateral-sides covers 73, 74 and a pair of backside covers 75, 76.

In the space 44, there is provided a catching device 80 for catching the objects, such as dirt or water, objects from the clearance between the door-side inner wall 1*a* of the hoistway 1 and the upper cage 6.

The upper door-side cover 71 has an inclined lower portion 71*a* entering the space 44 at its lateral horizontal mid-section, which absorbs the horizontal position difference between the upper and lower cages 6, 7 so that the air flow can smoothly flow along the door-side surface of the upper and lower cages 6, 7.

The lower door-side cover 72 has an opening 72*a* through which a catching plate 81 of the device 80 approaches and retracts from the door-side inner wall 1*a* of the hoistway 1. Also, the lower door-side cover 72 has a vertical wall 72*b* positioned closer to the door-side inner wall 1*a* of the hoistway 1 than the catching device 80, to prevent the airflow from flowing around the catching device 80 and generating air turbulence noise.

By this arrangement, even when a catching device 80 is provided in the space 44, the door-side cover 71, 72 guide the air flow to reduce air turbulence noise and ensure a quieter and more comfortable ride in the upper and lower cages 6, 7.

The catching device 80 comprises the catching plate 81 mentioned above which approaches the retracts the door-side inner wall 1*a* of the hoistway 1, and a driving motor 83 which swings the catching plate 81 around the horizontal swinging axis 82.

When the upper and lower cages 6, 7 stop moving vertically in the hoistway 1, the catching plate 81 approaches the door-side inner wall 1*a* of the hoistway 1 and extends horizontally as shown in FIGS. 13B and 14A so that its free end 81 a contacts the door-side inner wall 1*a*. And this catching plate 81 receives the objects to prevent the objects from dropping toward the passengers entering and exiting the lower cage 7.

Before the upper and lower cages 6, 7 start moving vertically, the catching plate 81 retracts from the door-side inner wall 1*a* so as not to prevent vertical movement of the cages 6, 7. Also, this catching plate 81 inclines parallel to the inclined lower portion 71*a* of the upper door-side cover 71 as shown in FIG. 14B, so that the airflow flows smoothly along the outer surface of the upper and lower door-side cover 71, 72.

The inclined lower portion 71*a* of the upper door-side cover 71 serves as a stopper for limiting the moving stroke of the catching plate 81. As a result, it is not necessary to provide the catching device 80 with a stopper.

Furthermore, a horizontally extending clearance-closing member 71*b* made of sponge rubber strip is provided on the inclined lower portion 71*a*, and the free and 81 a of the catching plate 81 strongly presses this clearance-closing member 71*b* against the inclined lower portion 71*a*.

In this manner, the clearance between the upper door-side cover 71 and the catching plate 81 is surely closed, and the airflow can not enter the space 44 through the clearance and do not generate air turbulence noise.

In an embodiment of the double deck elevator shown in FIGS. 15A, 15B, there is provided a clearance-closing means 90 for closing the clearance between the vertical wall 72*b* of the lower door-side cover 72 and the catching plate 81.

The clearance-closing member 90 comprises a slide plate 61 slidably held by the vertical wall 72*b* of the lower door-side cover 72, and a connecting link 92 which is pivotably connected to the lower surface of the catching plate 81 at its one end via a connecting portion 81*b* and to the top end of the sliding plate 91 at its another end via connecting portion 91*a*.

The sliding plate 91 slides downwardly due to the weight thereof when the catching plate 81 approaches the door-side inner wall 1*a* of the hoistway 1 as shown in FIG. 15A. On the contrary, wall 1*a* of the hoistway 1 as shown in FIG. 15A. On the contrary, the sliding plate 91 slides upwardly pulled by the connecting link 92 when the catching plate 81 retracts from the door-side inner wall 1*a* of the hoistway 1 as shown in FIG. 15B.

By this arrangement, since the slide plate 91 always closes the clearance between the vertical wall 72*b* of the lower door-side cover 72 and the catching plate 81 without disturbing the movement of the catching plate 81, the airflow flows smoothly along the door-side covers 71, 72, and does not enter the space 44 through the clearance and does not generate air turbulence noise.

Figure 16:
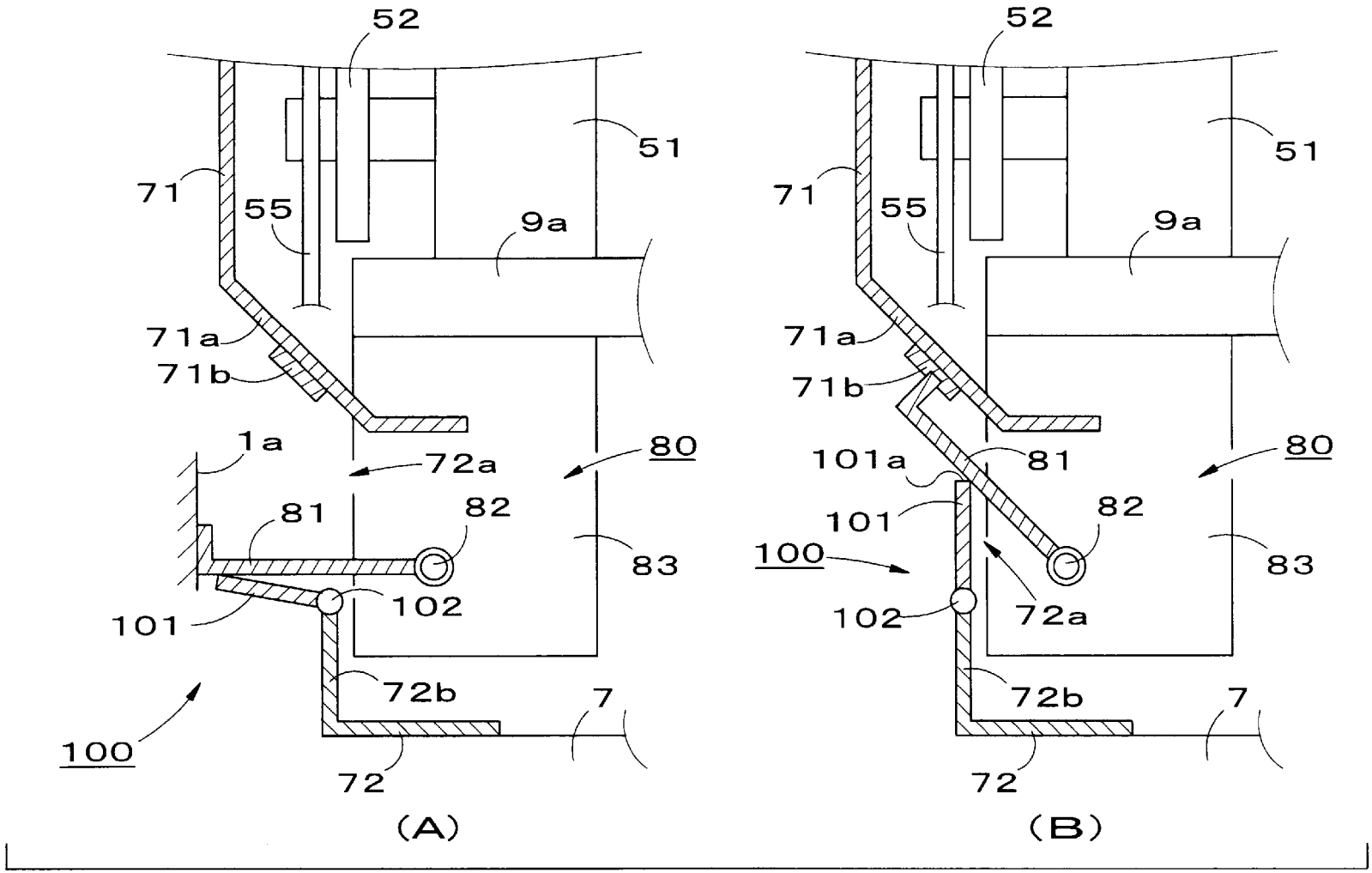
FIGS. 16A and 16B are enlarged sectional side elevation views of the clearance-closing member of another embodiment.

In an embodiment of the double deck elevator shown in FIGS. 16A, 16B, there is provided a clearance-closing means 100 for closing the clearance between the vertical wall 72*b* of the lower door-side cover 72 and the catching plate 81.

The clearance-closing means 100 comprises a pivot plate 101 pivotably connected to the vertical wall 72*b* of the lower door-side cover 72 at its lower end via a horizontally extending axis 102. And this pivot plate 101 is always biased to rotate around the axis 102 by a biasing means (not shown) such as a torsion bar, so that the upper end 101*a* of the pivot plate 101 always contacts the lower surface of the catching plate 81.

When the catching plate 81 approaches the door-side inner wall 1*a* of the hoistway 1, the pivoting plate 101 pivots counterclockwise around the horizontal axis 102 opposing to the biasing forces and inclines toward the door-side inner wall 1*a* as shown in FIG. 16A. On the contrary, when the catching plate 81 retracts from the inner wall 1*a* of the hoistway 1, the pivot plate pivots clockwise biased by the biasing means as shown in FIG. 16B.

By this arrangement, since the pivot place 101 always closes the clearance between the vertical wall 72*b* of the lower door-side cover 72 and the catching plate 81 without disturbing the movement of the catching plate 81, the airflow flows smoothly along the door-side covers 71, 72, and does not enter the space 44 through the clearance and does not generate air turbulence noise.

Figure 15:
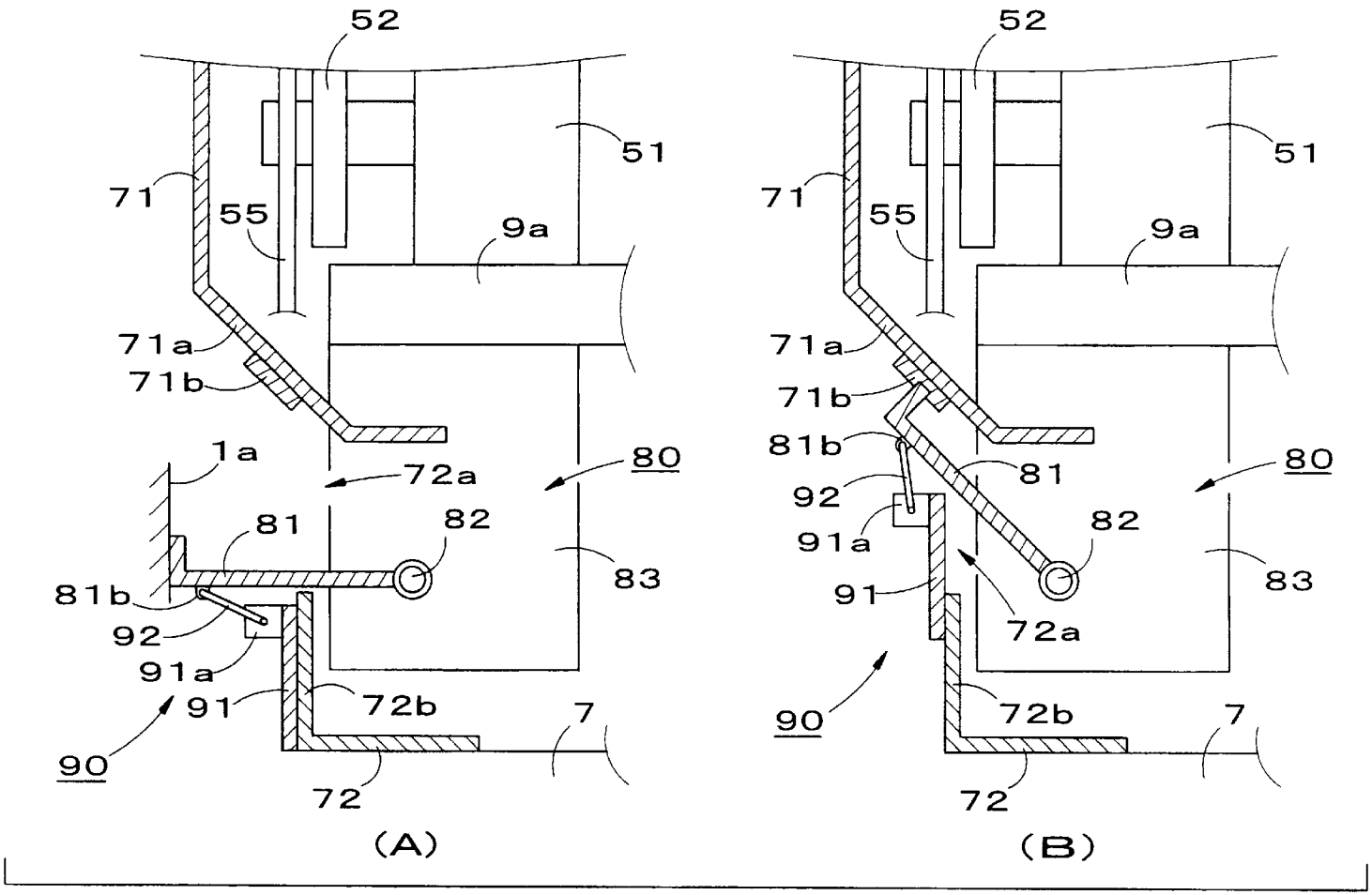
FIGS. 15A and 15B are enlarged sectional side elevation views of the clearance-closing member of another embodiment.

In addition, it is possible to eliminate the biasing means, and to connect the top edge 101*a* of the pivot plate 101 via a connecting link (as shown in FIG. 15) to the catching plate 81.

Figure 17:
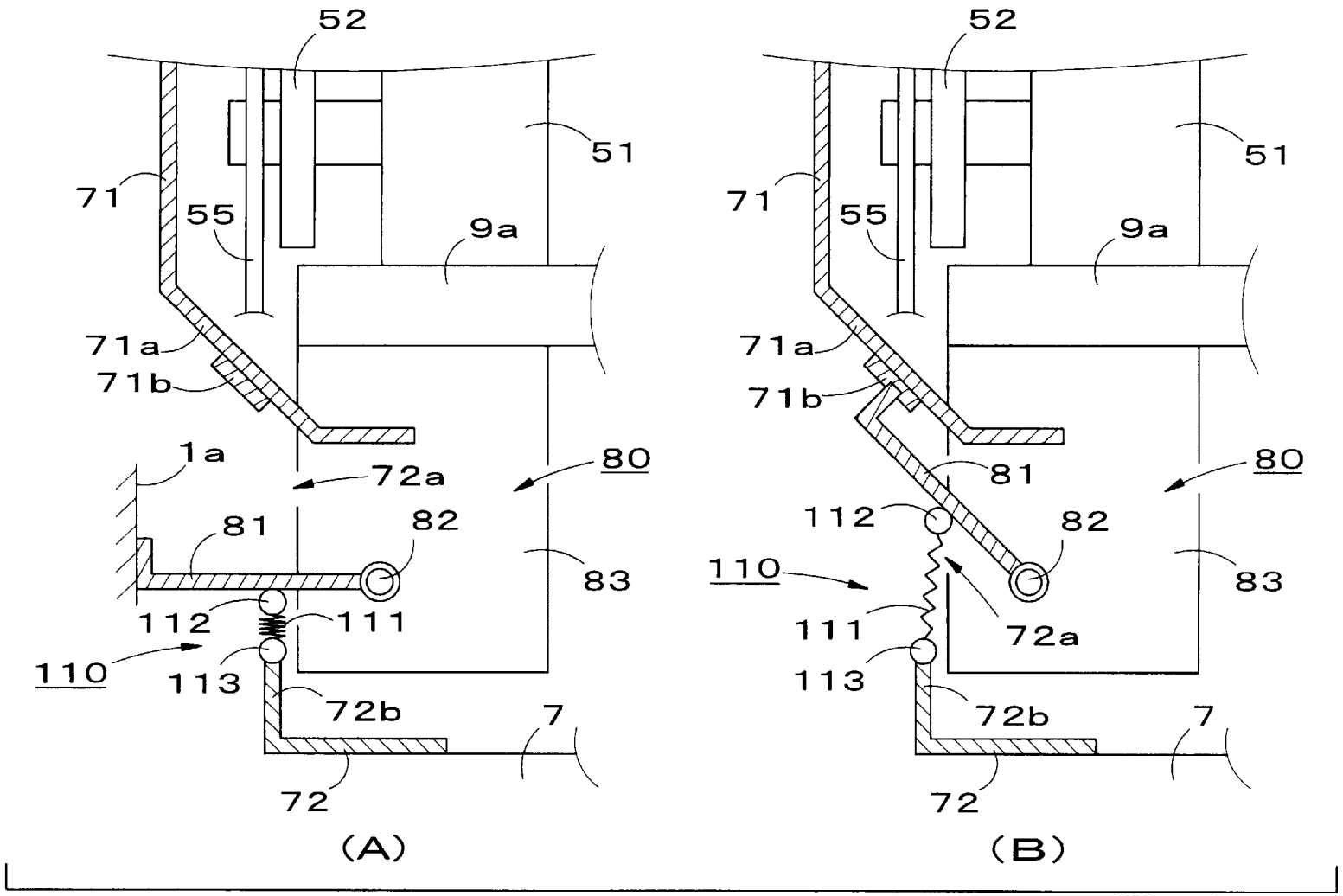
FIGS. 17A and 17B are enlarged sectional side elevation views of the clearance-closing member of another embodiment.

In an embodiment of the double deck elevator shown in FIGS. 17A, 17B, there is provided a clearance-closing means 110 for closing the clearance between the vertical wall 72*b* of the lower door-side cover 72 and the catching plate 81.

The clearance-closing means 110 comprises a bellows 111 made of an elastic material such as a rubber plate or plastic film, which is connected to the falling matter catching plate 81 via connecting portion 112 at upper end thereof, and is connected to the lower door-side cover 72 via connecting portion 113 at lower end thereof.

When the catching plate 81 approaches the door-side inner wall 1*a* of the hoistway 1, the bellows 111 contracts as shown in FIG. 17A. On the contrary, when the catching plate 81 moves apart from the inner wall 1*a* of the hoistway 1, the bellows expands as shown in FIG. 17B.

By this arrangement, since the bellows 111 always closes the clearance between the vertical wall 72*b* of the lower door-side cover 72 and the catching plate 81 without disturbing the movement of the catching plate 81, the airflow flows smoothly along the door-side covers 72, 72, and does not enter the space 44 through the clearance and does not generate air turbulence noise. In addition, instead of the bellows 111, it is possible to use straight elastic material that is expandable and contractible, such as thin rubber film.

Figure 18:
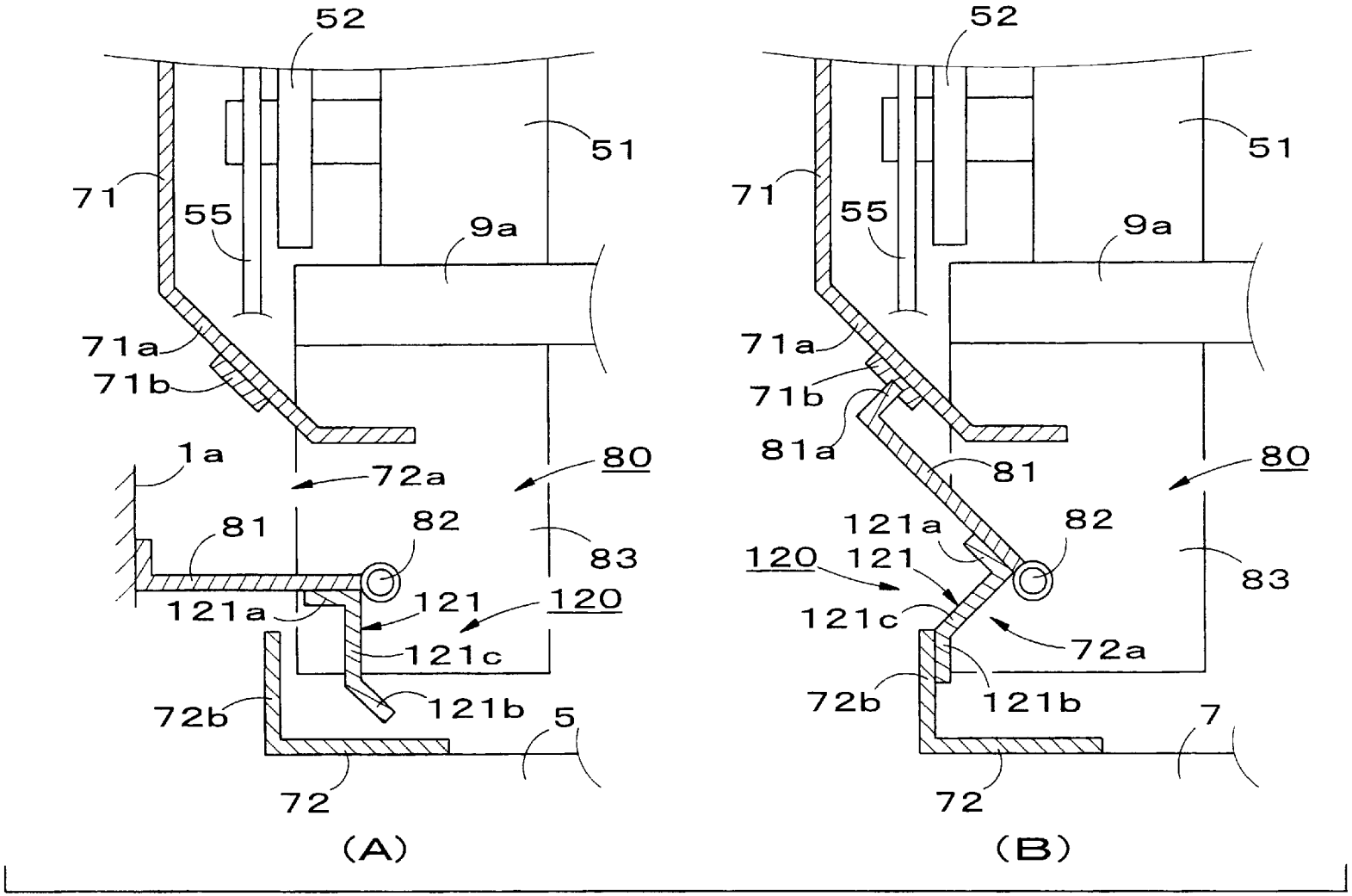
FIGS. 18A and 18B are enlarged side sectional elevation views of an opening closing member.

In an embodiment of the double deck elevator shown in FIGS. 18A, 18B, there is provided a clearance-closing means 120 for closing the clearance between the vertical wall 72*b* of the lower door-side cover 72 and the catching plate 81.

The clearance-closing means 120 comprises a closing plate 121, which is fixed to the lower surface of the catching plate 81 at its base end 121*a* and moves together with the catching plate 81.

When the catching plate 81 approaches the door-side inner wall 1*a* of the hoistway 1, the free end 121*b* of the closing plate 121 is in the space 44 apart from the inner surface of the vertical wall 72*b* of the lower door-side cover 72 as shown in FIG. 18A. On the contrary, when the catching plate 81 retracts from the inner wall 1*a* of the hoistway I and its free end 81*a* contacts the inclined lower portion 71*a* of the upper door-side cover 71 via the clearance-closing member 71*b*, the free end 121*b* of the closing plate 121 rests on the inner surface of the vertical wall 72*b* and closes the clearance between the vertical wall 72*b*. and the catching plate 81.

By this arrangement, since the closing plate 121 closes the clearance between the vertical wall 72*b* and the catching plate 81 without disturbing the movement of the catching plate 81, the airflow flows smoothly along the door-side covers 71, 72, and does not enter the space 44 through the clearance and does not generate air turbulence noise.

Figure 19:
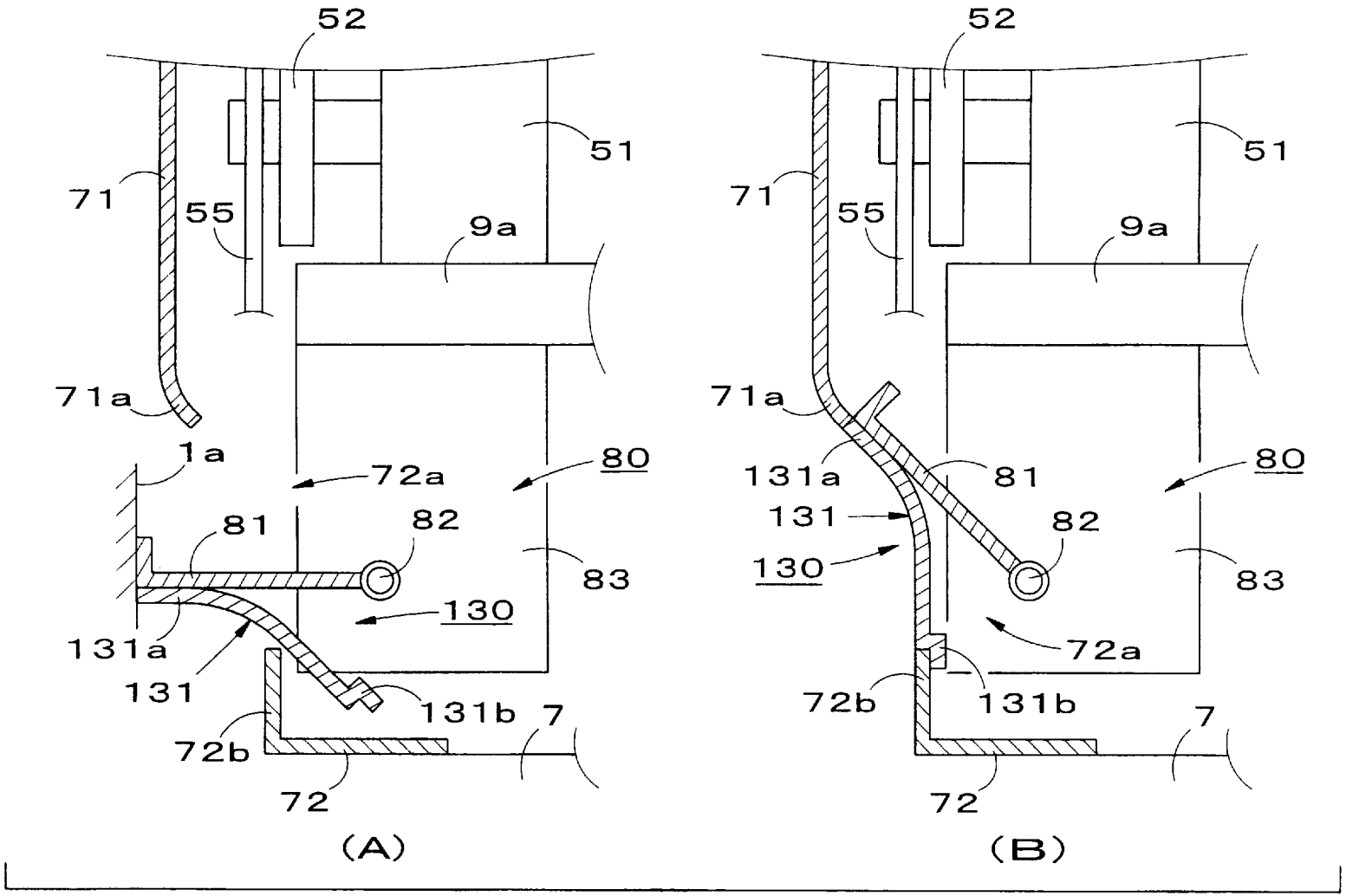
FIGS. 19A and 19B are enlarged side sectional elevation views of an opening closing member of another embodiment.

In an embodiment of the double deck elevator shown in FIGS. 19*a*, 19*b*, there is provided an opening closing means 130 for closing the opening 72*a* of the lower door-side cover 72.

The opening closing means 130 comprises a closing plate 131, which is fixed to the lower surface of the catching plate 81 at its one end 131*a* and moves together with the catching plate 81.

When the catching plate 81 approaches the door-side inner wall 1*a* of the hoistway 1, the free end 131*b* of the closing plate 131 is in the space 44 apart from the inner surface of the vertical wall 72*b* of the lower door-side cover 72 as shown in FIG. 19A. On the contrary, when the catching plate 81 retracts from the inner wall 1*a* of the hoistway 1, the free end 131*b* of the closing plate 131 rests on the inner surface of the vertical wall 72*b* and stops the movement of the catching plate 81, at the same time, the closing plate entirely closes the opening 72*a* of the lower door-side cover 72 as shown in FIG. 19B.

Furthermore, the closing plate 131 has an outer surface 131*c* which is connected to the door-side covers 72 without any steps, when the closing plate 131 closes the opening 72*a*.

By this arrangement, since the closing plate 131 closes the opening 72*a* without. disturbing the movement of the catching plate 81, the airflow flows smoothly along the door-side covers 71, 72, and does not enter the space 44 through the opening 72*a* and does not generate air turbulence noise.

Figure 20:
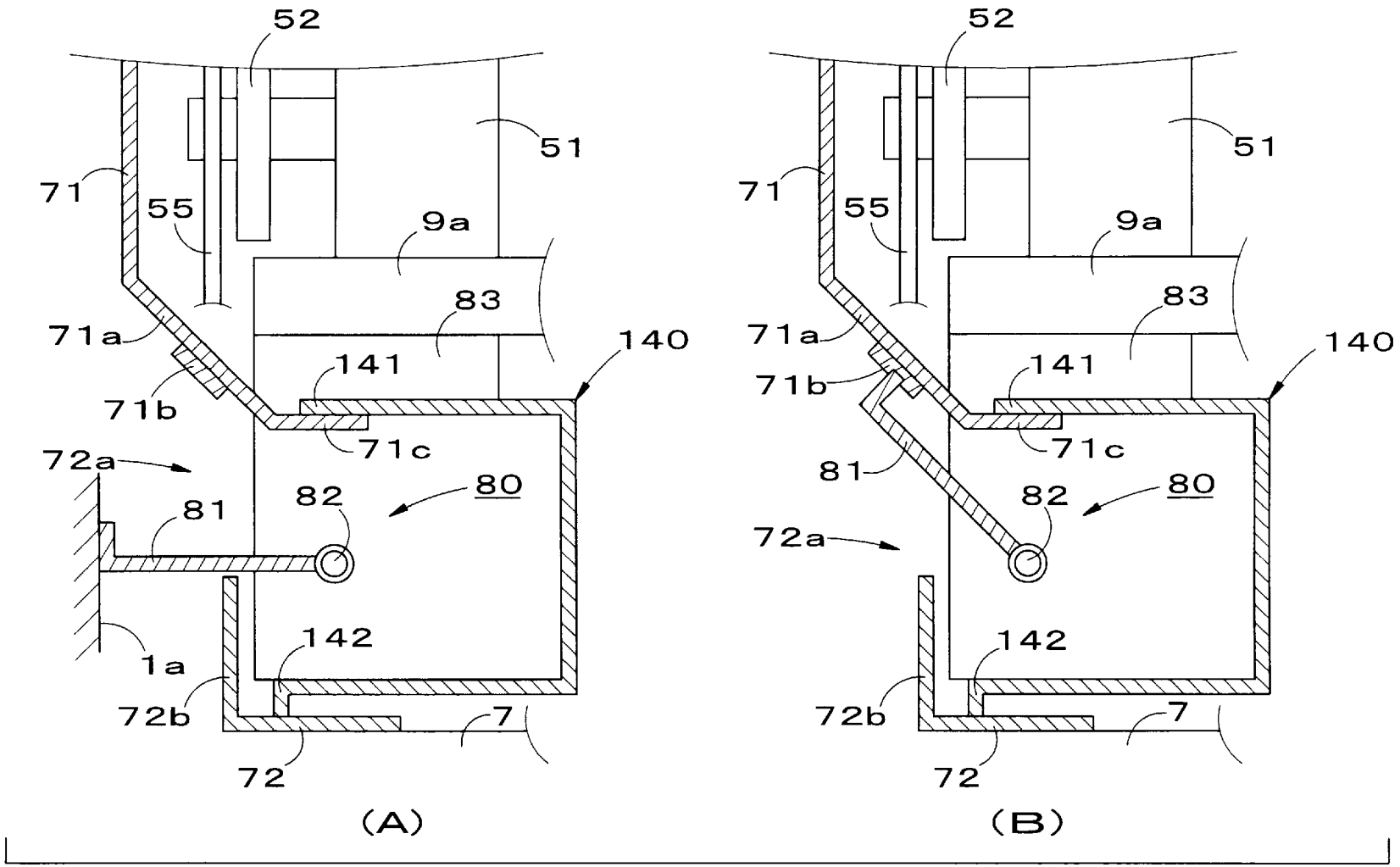
FIGS. 20A and 20B are enlarged side sectional elevation views of a noise insulating member.

In an embodiment of the double deck elevator shown in FIGS. 20A, 20B, there is provided a box-like noise-insulating member 140 for insulating the noise entering the space 44 between the upper and low cages 6, 7 from the opening 72*a* of the lower door-side cover 72.

The noise-insulting member 140 is open toward the opening 72*a*, and is connected to the lower end 71*c* of the upper door-side cover 71 at its front upper edge 141, and is further connected to the lower door-side cover 72 at its front lower edge 142. It is preferable to attach noise-absorbing material, such as glass fiber, to the inner surface of the noise-insulating member 140.

By this arrangement, since the noise entering from the opening 72*a* is insulated and absorbed in the noise-insulating member 140 without disturbing the movement of the catching plate 81, a quieter and more comfortable ride in the upper and lower cages 6, 7 can be achieved.

Figure 21:
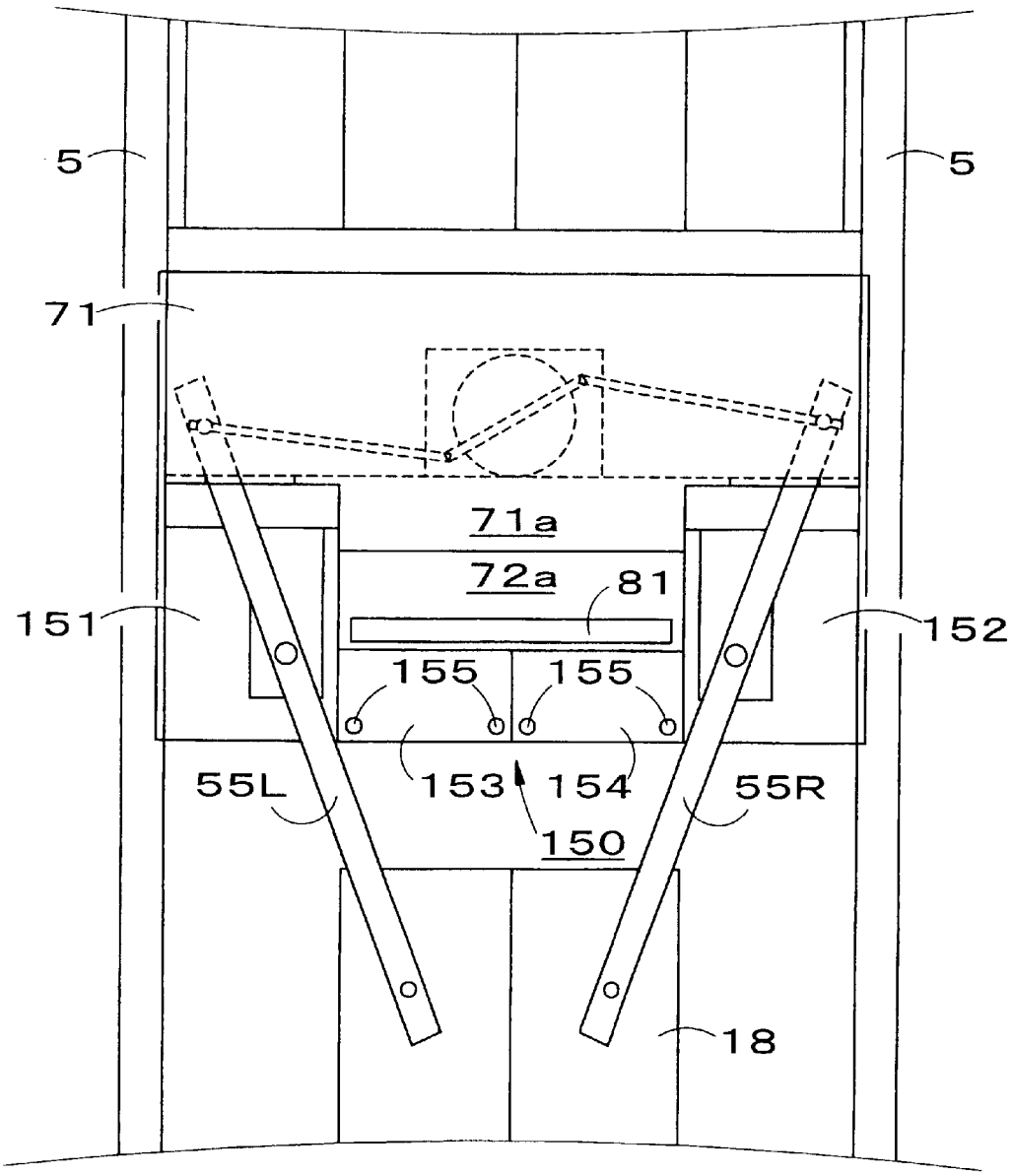
FIG. 21 is an enlarged schematic front view showing a double deck elevator of another embodiment of the present invention.
Figure 22:
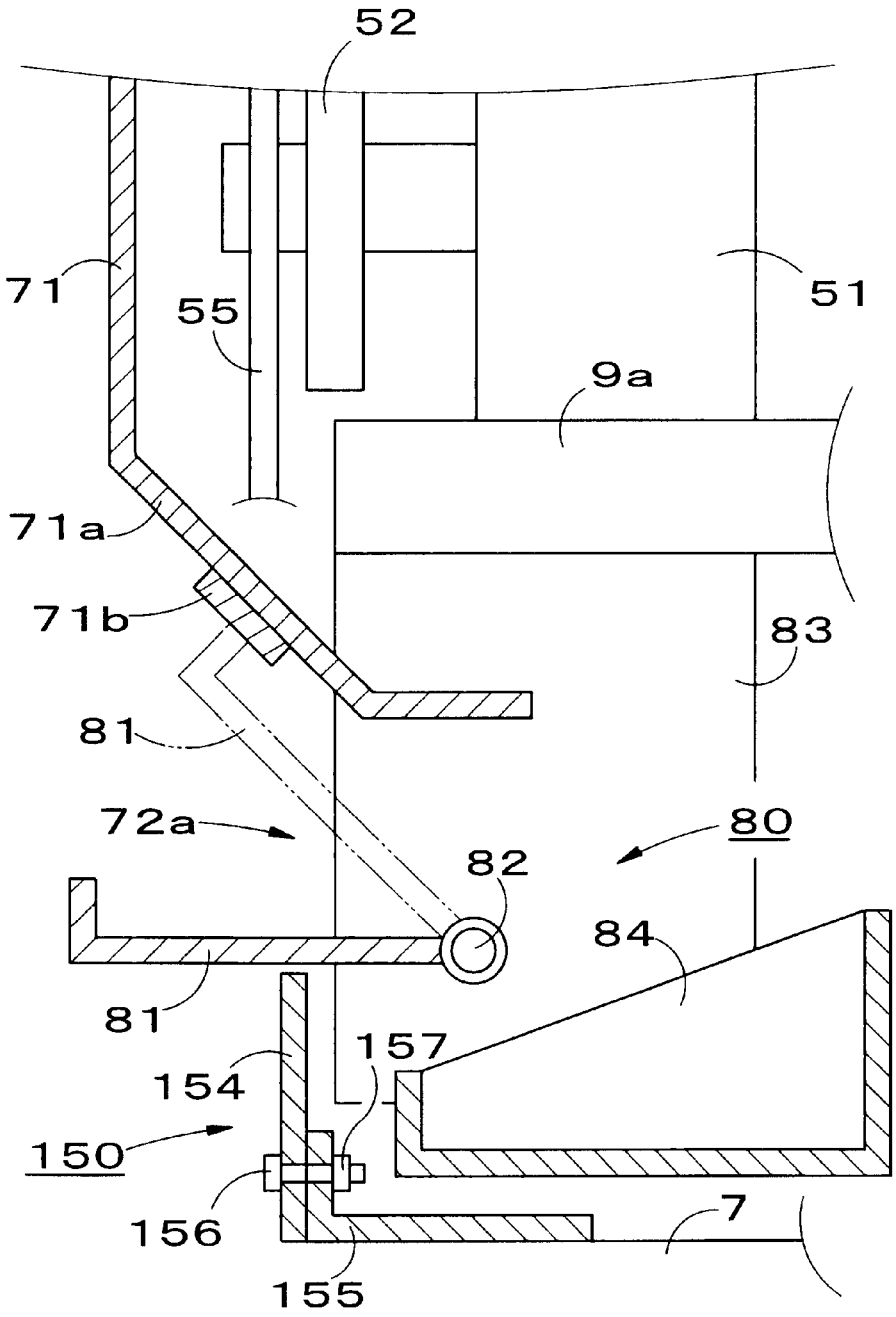
FIG. 22 is an enlarged sectional side elevation view of the covers shown in FIG. 21.
Figure 23:
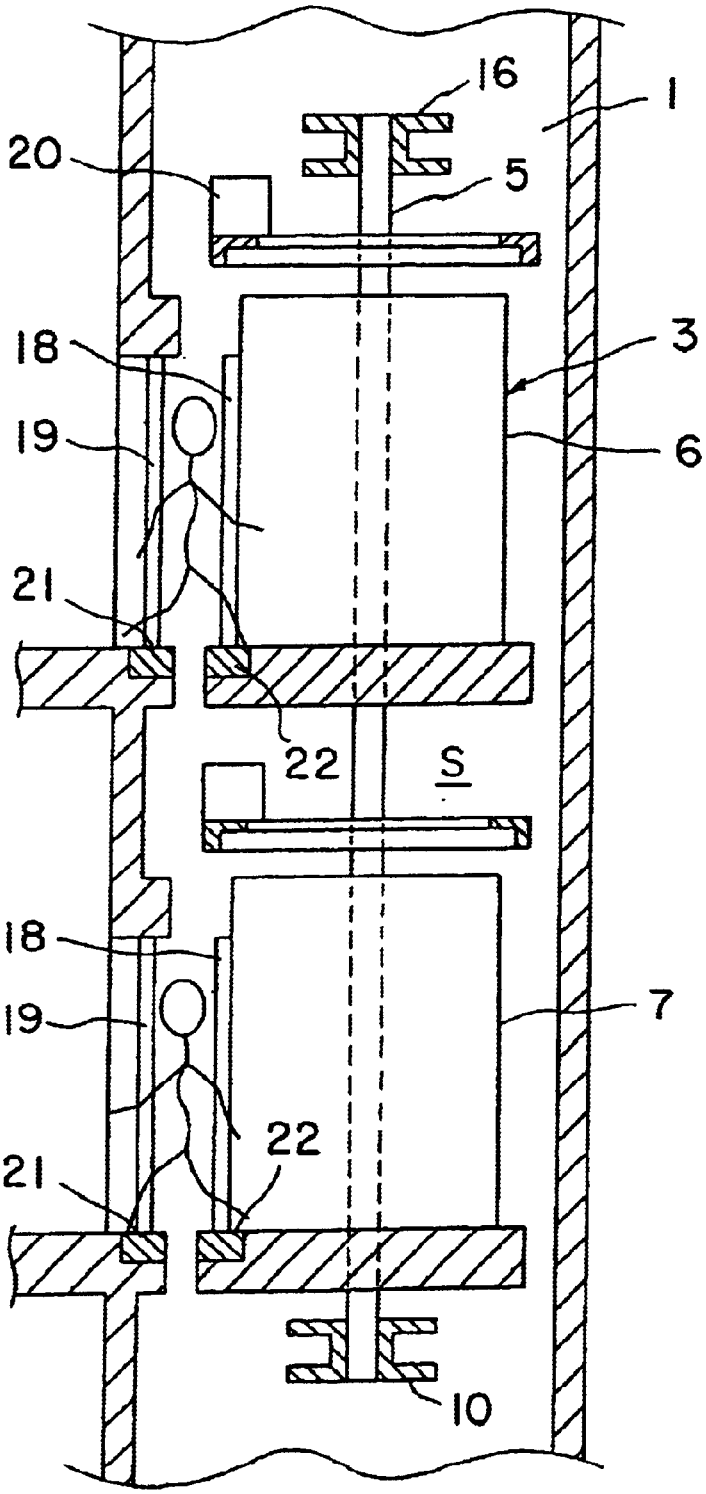
FIG. 23 PRIOR ART
FIG. 23 is a schematic side sectional elevation view showing a double deck elevator of the prior art.
Figure 24:
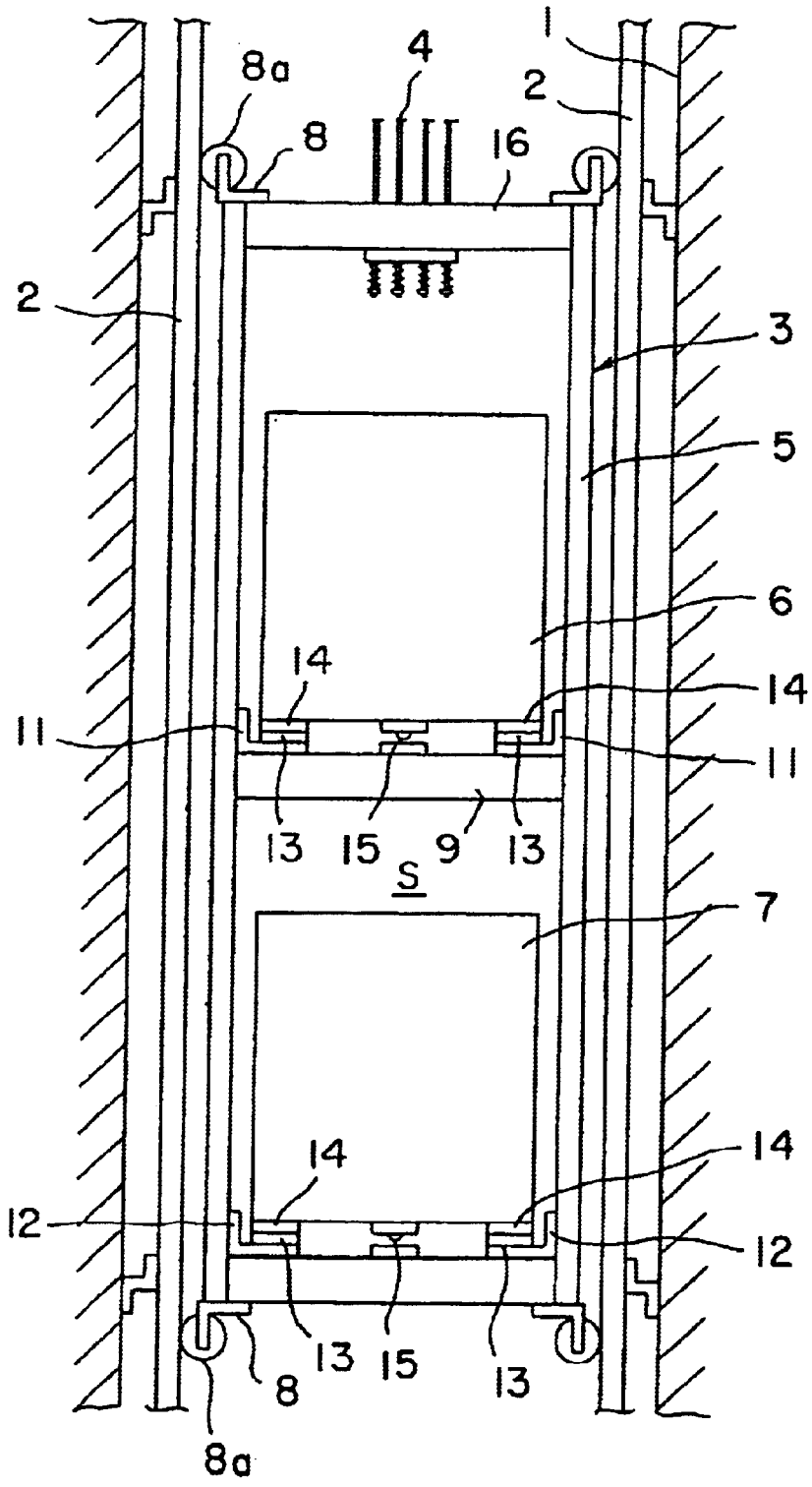
FIG. 24 PRIOR ART
FIG. 24 is a schematic front elevation view showing another double deck elevator of the prior art.
Figure 25:
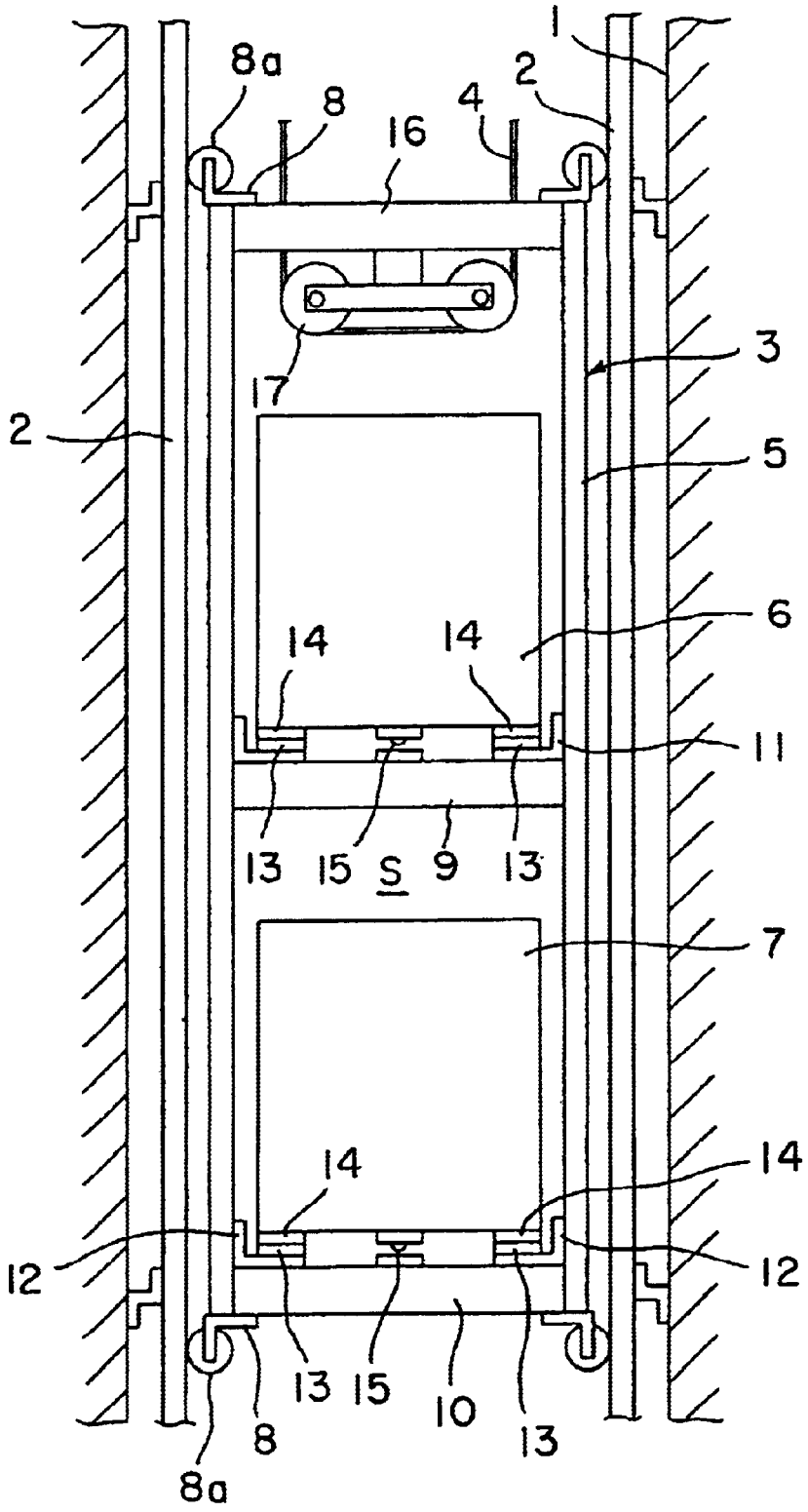
FIG. 25 PRIOR ART
FIG. 25 is a schematic front elevation view showing another double deck elevator of the prior art.

In an embodiment of the double deck elevator shown in FIGS. 21 and 22, there is provided a objects storing box 84 for storing the objects caught by the catching plate 81. That is, the objects caught by the catching plate 81 is guided to drop into the storing box 84 when the catching plate 81 retracts from the door-side inner wall 1*a* and inclines as shown in FIG. 23 by phantom lines.

Therefore, it is necessary to remove the objects stored in the storing box 84, when the maintenance or inspection of the double deck elevators is performed. However, it is difficult to remove the falling matters stored in the storing box 84 in the above-mentioned double deck elevator, due to the presence of the lower door-side cover 72.

For this reason, the lower door-side cover 150 in this embodiment is divided into four parts 151, 152, 153 and 154 as shown in FIG. 21. Especially, the parts 153, 154 facing the storing box 84 are smaller than the floor-side door openings respectively. In other words, the horizontal width of the parts 153, 154 is smaller than the horizontal width or the vertical height of the floor-side door opening, which is formed when the floor-side doors 19 open.

Furthermore, as shown in FIG. 22, the door parts 153, 154 are removably mounted to the bracket 155 fixed on the lower cage 7 by means of butter fly screws 156 and nuts 157, respectively.

Therefore, when the double deck elevator of this embodiment is inspected or maintained, the worker on the floor can easily remove the parts 153, 154 by manually loosening the butter fly screws 156 through the floor-side door opening and placing them on the floor. After removing the parts 153, 154 from the lower cage 7, it is easy to access the store box 84 to remove the stored objects. Similarly, it is easy to mount the parts 153, 154 to the lower cage 7.

While the many preferred embodiments of the invention have been described, such description is for illustrative purpose only, and it is to be understood that changes and variations may be made without departing from the spirit or scope of the following claims.

What is claimed is:

1. A double deck elevator comprising:

an upper cage and a lower cage mounted on a cage frame and vertically movable together in a hoistway;

covers for covering a space between the upper cage and the lower cage and for guiding airflow along outer surfaces of the upper cage and the lower cage, said covers comprising door-side cover, lateral-side cover and backside cover; and a catching device for catching objects dropped through a clearance between a door-side inner wall of the hoistway and the upper cage, said catching device including a catching plate being capable of swinging about horizontal axis between a first position in which a distal end thereof contacts a door-side inner wall of the hoistway and a second position in which the distal end retracts from the door-side inner wall, a driving means for driving said catching plate so that said catching plate swings between said first position and said second position, wherein said catching plate in the second position guides the airflow together with the door-side cover so that the airflow flows smoothly along an outer surface of the door-side cover.

2. The double deck elevator according to claim 1, wherein said catching plate extends parallel to the door-side cover in said second position.

3. The double deck elevator according to claim 1, wherein said driving means is positioned in the space.

4. The double deck elevator according to claim 1, wherein said door-side cover has an opening through which said catching plate swings between the first position and the second position.

5. The double deck elevator according to claim 4, wherein said door-side cover serves as a stopper for limiting a swing stroke of the catching plate at the second position.

6. The double deck elevator according to claim 4, further comprising a clearance closing member for closing a clearance between the distal end of the catching plate in the second position and the door-side cover, said clearance closing member being made of elastic material and being pressed against the door-side cover by the distal end of the catching plate in the second position.

7. The double deck elevator according to claim 4, further comprising a clearance closing means for closing a clearance between the catching plate in the second position and a periphery of the opening of the door-side cover.

8. The double deck elevator according to claim 7, wherein said clearance closing means is a slide plate, said slide plate being slidably held by the door-side cover, and being connected to the catching plate with a connecting member so that said slide plate slides toward the catching plate and closes the clearance when said catching plate is in the second position.

9. The double deck elevator according to claim 7, wherein said clearance closing means is a pivot plate, said pivot plate being pivotably connected to the door-side cover and being biased toward the catching plate by a biasing means so that said pivot plate pivots toward the catching plate and closes the clearance when said catching plate is in the second position.

10. The double deck elevator according to claim 7, wherein said clearance closing means is a pivot plate, said pivot plate being pivotably connected to the door-side cover and being connected to the catching plate with a connecting member so that said pivot plate pivots toward the catching plate and closes the clearance when said catching plate is in the second position.

11. The double deck elevator according to claim 7, wherein said clearance closing means is an elastic member, said elastic member being made of an elastic material capable of stretching and contracting, and being connected to the catching plate at a proximal end thereof and connected to the door-side cover at a distal end thereof, so that said elastic member contracts when said catching plate is in the first position and said elastic member stretches and closes the clearance when said catching plate is in the second position.

12. The double deck elevator according to claim 7, wherein said clearance closing means is a cover plate, said cover plate being fixed to the catching plate and being configured to swing with the catching plate, so that the cover plate covers the clearance when said catching plate is in the second position.

13. The double deck elevator according to claim 7, further comprising a noise insulating member arranged in the space for insulating noise entering through the opening of the door-side cover.

14. The double deck elevator according to any one of claims 1–13 wherein said door-side cover is divided into parts which are smaller than a floor-side door opening.

15. The double deck elevator according to claim 14, wherein said parts of the door-side cover are removably mounted to at least one of the upper cage, the lower cage and the cage frame by means of a mounting means manually operable from the floor-side door opening.

* * * * *

UNITED STATES PATENT AND TRADEMARK OFFICE

CERTIFICATE OF CORRECTION

PATENT NO. : 6,615,952 B2
DATED : September 9, 2003
INVENTOR(S) : Itoh et al.

It is certified that error appears in the above-identified patent and that said Letters Patent is hereby corrected as shown below:

Column 12,
Line 54, change "claim 7," to -- claim 4, --.
Line 59, change "claims 1-13" to -- claims 1-13, --.

Signed and Sealed this

Seventeenth Day of February, 2004

JON W. DUDAS
*Acting Director of the United States Patent and Trademark Office*